US010093475B2

(12) United States Patent
Massey et al.

(10) Patent No.: US 10,093,475 B2
(45) Date of Patent: Oct. 9, 2018

(54) CARD CASSETTE DEVICE AND CARD DISPENSING APPARATUS USING THE SAME

(71) Applicant: ASAHI SEIKO CO., LTD., Minato-ku, Tokyo (JP)

(72) Inventors: Alex Massey, Kent (GB); Marcus John Willis, Kent (GB)

(73) Assignee: ASAHI SEIKO CO., LTD., Tokyo (JP)

( * ) Notice: Subject to any disclaimer, the term of this patent is extended or adjusted under 35 U.S.C. 154(b) by 2 days.

(21) Appl. No.: 15/072,646

(22) Filed: Mar. 17, 2016

(65) Prior Publication Data

US 2016/0272406 A1 Sep. 22, 2016

(30) Foreign Application Priority Data

Mar. 19, 2015 (JP) ..... 2015-055498
Apr. 14, 2015 (JP) ..... 2015-082219

(51) Int. Cl.
*B65D 83/08* (2006.01)
*G07F 7/00* (2006.01)
(Continued)

(52) U.S. Cl.
CPC ..... *B65D 83/0852* (2013.01); *G07F 7/00* (2013.01); *G07F 9/00* (2013.01); *G07F 9/006* (2013.01); *G07F 11/00* (2013.01); *G07F 11/16* (2013.01)

(58) Field of Classification Search
CPC ... G07F 5/26; G07F 9/00; G07F 9/006; G07F 7/00; G07F 11/00; G07F 11/04; G07F 11/16; B65D 83/0852; B65H 2701/1914
See application file for complete search history.

(56) References Cited

U.S. PATENT DOCUMENTS 5,562,402 A * 10/1996 Muto ..... B01L 9/52 221/259
5,941,414 A * 8/1999 Kasper ..... G07B 3/04 221/210
(Continued)

FOREIGN PATENT DOCUMENTS

EP 0871150 10/1998
EP 1071052 1/2001
(Continued)

OTHER PUBLICATIONS

Search Report issued in European Patent Office (EPO) Patent Application No. 15179558.0, dated Aug. 22, 2016.

*Primary Examiner* — Gene O Crawford
*Assistant Examiner* — Kelvin L. Randall, Jr.
(74) *Attorney, Agent, or Firm* — Greenblum & Bernstein, P.L.C.

(57) ABSTRACT

A card cassette device ensures elimination of measures for illegally opening a card outlet from the outside in a non-mounted state and makes it possible to open the card outlet according to the necessity in a mounted state, raising security level. A movable shutter for opening and closing a card outlet has a stopper member engaging hole and a lock member engaging hole. A stopper member is engaged with the stopper member engaging hole by a stopper member moving device, thereby fixing the shutter in its closed state in the non-mounted state. A lock member is engaged with the lock member engaging hole by a lock member moving device, thereby canceling the closed state of the shutter and locking the shutter in its open state in the mounted state.

9 Claims, 33 Drawing Sheets

(51) Int. Cl.

| | |
|---|---|
| ***G07F 9/00*** | (2006.01) |
| ***G07F 11/00*** | (2006.01) |
| ***G07F 11/16*** | (2006.01) |

(56) References Cited

U.S. PATENT DOCUMENTS

| | | | | |
|---|---|---|---|---|
| 6,938,896 | B2 * | 9/2005 | Tsuchida | A63F 1/14<br>221/268 |
| 2011/0301750 | A1 | 12/2011 | Xiao | |

FOREIGN PATENT DOCUMENTS

| | | |
|---|---|---|
| EP | 1550625 | 7/2005 |
| JP | 3858567 | 9/2006 |
| JP | 4604003 | 10/2010 |

* cited by examiner

CARD CASSETTE DEVICE AND CARD DISPENSING APPARATUS USING THE SAME

BACKGROUND OF THE INVENTION

1. Field of the Invention

The present invention relates to a card cassette device and a card dispensing apparatus using the same and more particularly, to a card cassette device configured to be mountable on the main unit of a predetermined target apparatus, such as a card dispensing apparatus, and that makes sure to prevent loss and theft of cards placed inside of the device to thereby realize a higher security level than before, and a card dispensing apparatus using the card cassette device.

The term "card" used in this specification means widely card-shaped articles, which includes not only card-shaped information storage media (i.e., information storage medium cards) with transparency but also cards or card-shaped articles with transparency and/or information storage function. Concretely speaking, the term "card" includes telephone cards, prepaid cards, character cards, bromides (i.e., photographic printing paper), cards for amusement, magnetic stripe cards (e.g., credit cards and bank cards), IC (Integrated Circuit) cards, cards with bar codes, and sheet-shaped articles made of paper or plastic or the like whose thickness is equivalent to or greater than the thickness of cards of the types as described here.

2. Description of the Related Art

Typically, card dispensing apparatuses are provided with a card cassette device that stores a plurality of cards in a stacked form therein and that dispenses the stacked cards one by one through a card outlet according to the necessity. This card cassette device is configured to be detachably mounted on the main unit of the card dispensing apparatus, and the loading or adding operation of new cards is carried out in the non-mounted state where the card cassette device is dismounted from the main unit. Since the cards stored in the device have a monetary value, there arises a problem if at least part of the cards are lost or stolen during this operation. In addition, there is a danger that a similar problem will occur during the storing, using, and transporting operations of the card cassette device also. For this reason, it is usual for the card cassette device to have a mechanism for inhibiting unauthorized access to the cards stored therein by definitely closing the card outlet in both the mounted state and the non-mounted state.

To enhance the security for the card cassette device of this type, various technologies have ever been developed and proposed. One of such the conventional technologies is the "cassette device for cards" disclosed in Patent Literature (Japanese Patent No. 3858567 issued in September 2006) and another is the "card issuing machine" disclosed in Patent Literature 2 (Japanese Patent No. 4604003 issued in October 2010).

The cassette device for cards disclosed in Patent Literature 1 comprises a structure formed by making the card storing section independent from the main unit of the card dispensing apparatus in the form of a cassette. This cassette device comprises a cassette means for storing a plurality of cards in a stacked form, a gate means for opening and closing the card outlet of the cassette means, a converse-operation preventing means for preventing the converse operation of the gate means in the open state of the gate means, a converse-operation prevention canceling means for canceling the converse-operation preventing means in the open state of the gate means, and a locking means for locking the gate means in the closed state of the gate means.

With the cassette device of Patent Literature 1, while the card outlet is being opened by the gate means, the converse operation, i.e., the closing operation of the card outlet, is prevented by the converse-operation prevention means and the open state of the card outlet is kept unchanged; when the converse operation prevention is canceled by the converse-operation prevention canceling means in the open state, the card outlet can be made closable. Then, when the card outlet is closed, the closed state of the card outlet is locked by the locking means and therefore, the closed state of the card outlet is kept unreleasable. Therefore, even in the state where the cassette device is mounted on the main unit of the card dispensing apparatus and in the state where the cassette device is dismounted from the main unit thereof, any situation where the card may be lost will not occur. Accordingly, card management can be carried out easily and accurately. (See FIGS. 1 to 7, Claim 1, and Paragraphs 0016 to 0029.)

The card issuing machine of Patent Literature 2 comprises a card stacker (a cassette device for cards) for storing a plurality of cards in a stacked form, a hopper on which the cassette device is mounted, and a feeding means for feeding the cards placed in the cassette device one by one. The cassette device comprises a shutter for closing the card outlet when this cassette device is dismounted from the hopper, a supporting plate for supporting the movement of the shutter, and a shutter structure having a regulating means for regulating the movement of the shutter to the open position. The hopper comprises an engaging member that moves the shutter from the closed position to the open position when the cassette device is mounted on the hopper. The regulating means of the shutter structure comprises a first contact member that is moved horizontally due to contact with the oblique face of the engaging member, a first regulating member that prevents the shutter from moving to the open position, and a first biasing member that biases or energizes the first contact member in such a way as to be contacted with the oblique face.

With the card issuing machine of Patent Literature 2, the engaging member and the shutter structure are engaged with each other to thereby open the shutter by simply mounting the card stacker on the hopper. Thus, keys are not required and labors such as extraction and insertion of keys are not spent. Moreover, with this shutter structure, the shutter cannot be opened without using the engaging member that regulates the movement of the first regulation member by abutting this engaging member with the first contact member, card issuing machine is safe from the viewpoint of security. (See FIGS. 1 to 6, Claim 1, and Paragraphs 0008, 0032 to 0041.)

Furthermore, from the viewpoint of security, the card loading operation of a card cassette device must be carried out by a person having a specific authority. For this reason, there is the need to cope with the following application or use.

Specifically, for example, the card loading operation for a card cassette device, which is dismounted from the main unit of a card dispensing apparatus, is performed in the management center and thereafter, the card cassette device thus loaded is transported to the place where the main unit is set up and is mounted on the main unit at that place. In such the application as described here, it is essential to provide a system or mechanism that allows only one previously-designated card cassette device to be mounted on the main unit in question. In other words, the card cassette device and the main unit in question need to have the relationship of one-to-one correspondence.

With the aforementioned cassette device disclosed in Patent Literature 1, both in the mounted state where the cassette device is mounted on the main unit and the non-mounted state where the cassette device is dismounted from the same, the card outlet is kept in the closed state (except for the time when a card dispensing instruction is received). Therefore, the cards are prevented from being lost and stolen. However, this function of preventing the lost and theft of the cards is realized by utilizing a cam means for the gate means. Moreover, the security is ensured by operating the cam means with a knob means in order to make the closed state of the card outlet unreleasable.

In this way, the security of the cassette device of Patent Literature 1 is realized by mechanically limiting the relative rotation or movement among the members that are engaged with each other, such as a bracket plate, a shaft, a cam plate, a pin, and the like. However, in the non-mounted state where the cassette device is dismounted from the main unit, it is particularly easy to apply some treatment or change to the knob means. This means that it is not difficult to break the security to access the cards stored in the cassette device. As a result, it cannot be said that the security level of this cassette device is sufficient.

With the aforementioned card issuing machine disclosed in Patent Literature 2, the shutter is designed to be opened by engaging the shutter structure (which is provided on the cassette device and which includes the shutter, the supporting plate and the regulating means) with the engagement member formed on the hopper. Therefore, the shutter is unable to be opened in the non-mounted state where the cassette device is dismounted from the hopper unless an appropriate member whose shape and size are approximately matched with those of the engaging member is prepared and the member thus prepared is engaged with the shutter structure. However, on the contrary, this means that if a member whose shape and size are approximately matched with those of the engaging member is prepared, the shutter is able to be opened. Accordingly, it cannot be said that the security level of this card issuing machine is sufficient.

Furthermore, to ensure that the card cassette device and the main unit of the card dispensing apparatus have the relationship of one-to-one correspondence, it is desirable to realize a card dispensing apparatus that allows only one designated card cassette device to be mounted on a corresponding main unit of the card dispensing apparatus.

SUMMARY OF THE INVENTION

The present invention was created to solve the aforementioned problems of the prior art including the cassette device of Patent Literature 1 and the card issuing machine disclosed in Patent Literature 2.

Accordingly, an object of the present invention is to provide a card cassette device and a card dispensing apparatus that ensure elimination of measures for illegally opening a card outlet from the outside in a non-mounted state and that make it possible to open the card outlet according to the necessity in a mounted state.

Another object of the present invention is to provide a card cassette device and a card dispensing apparatus that realize a higher security level than those of the prior art with a simple structure.

Still another object of the present invention is to provide a card dispensing apparatus that makes it possible to allow only the use of a predetermined card cassette device conformable to a main unit having a card dispensing function.

The above objects together with others not specifically mentioned will become clear to those skilled in the art from the following description.

According to the first aspect of the present invention, a card cassette device configured to be mountable on a main unit of a target apparatus is provided, which comprises:

a body having a storing section for storing cards and a card outlet for sending out the cards, wherein the storing section is formed in the body and the card outlet is formed in a front part of the body;

a shutter for opening and closing the card outlet, wherein the shutter is movable along the front part of the body and has a stopper member engaging hole and a lock member engaging hole;

a stopper member provided on the body, wherein the stopper member is engageable with the stopper member engaging hole of the shutter;

a stopper member moving device for moving the stopper member and/or the stopper member engaging hole to perform engagement or disengagement of the stopper member with/from the stopper member engaging hole;

a lock member provided on the body, wherein the lock member is engageable with the lock member engaging hole of the shutter; and a lock member moving device for moving the lock member and/or the lock member engaging hole to perform engagement or disengagement of the lock member with/from the lock member engaging hole;

wherein the stopper member, the stopper member engaging hole, and the stopper member moving device constitute a shutter fixing mechanism for fixing the shutter in its closed state;

the lock member, the lock member engaging hole, and the lock member moving device constitute an open state locking mechanism for canceling the closed state of the shutter and locking the shutter in its open state;

the shutter fixing mechanism is configured in such a way that the closed state of the shutter generated by the shutter fixing mechanism is unable to be eliminated without mounting the card cassette device on a main unit of a target apparatus; and the open state locking mechanism is configured in such a way that the open state of the shutter is able to be generated and locked by operating the lock member moving device after releasing a shutter movement preventing operation by the shutter fixing mechanism in a mounted state where the card cassette device is mounted on the main unit.

With the card cassette device according to the first aspect of the present invention, as described above, the shutter for opening and closing the card outlet, which is movable along the front part of the body and which has the stopper member engaging hole and the lock member engaging hole, is provided, and the stopper member engageable with the stopper member engaging hole of the shutter and the lock member engageable with the lock member engaging hole of the shutter are provided.

Moreover, the combination of the stopper member, the stopper member engaging hole, and the stopper member moving device constitutes the shutter fixing mechanism for fixing the shutter in its closed state, in which engagement or disengagement of the stopper member with/from the stopper member engaging hole can be performed by the stopper member moving device. The combination of the lock member, the lock member engaging hole, and the lock member moving device constitute the open state locking mechanism for canceling the closed state of the shutter and locking the shutter in its open state, in which engagement or disengagement of the lock member with/from the lock member engaging hole can performed by the lock member moving device.

Furthermore, the closed state of the shutter generated by the shutter fixing mechanism is unable to be eliminated without mounting the card cassette device on the main unit of the target apparatus, and the open state of the shutter is able to be generated and locked by operating the lock member moving device after releasing the shutter movement preventing operation by the shutter fixing mechanism in the mounted state where the card cassette device is mounted on the main unit.

Therefore, the movement of the shutter for opening and closing the card outlet can be directly prevented by the shutter fixing mechanism and as a result, measures for illegally opening the card outlet from the outside in the non-mounted state can be eliminated surely.

In addition, since the open state of the shutter is able to be generated and locked by operating the lock member moving device of the open state locking mechanism after mounting the card cassette device on the main unit and releasing the shutter movement preventing operation by the shutter fixing mechanism, the card outlet can be opened according to the necessity in the mounted state.

In this way, with the card cassette device according to the first aspect of the present invention, measures for illegally opening the card outlet from the outside can be surely eliminated in the non-mounted state and the card outlet can be opened according to the necessity in the mounted state and therefore, a higher security level than the prior art can be realized with a simple structure.

In a preferred embodiment of the card cassette device according to the first aspect of the present invention, the stopper member moving device includes a solenoid and the stopper member is integrated with a rod of the solenoid.

In another preferred embodiment of the card cassette device according to the first aspect of the present invention, a guide member (e.g., a guide plate) is fixed to the stopper member (e.g., a solenoid rod) and a guide member engaging hole (e.g., a guide plate inserting hole) is formed in the shutter; wherein the guide member is guided by the guide member engaging hole according to the movement of the shutter in the state where the stopper member is disengaged from the stopper member engaging hole.

In a still another preferred embodiment of the card cassette device according to the first aspect of the present invention, when the solenoid is in a demagnetized state, the shutter is fixed in the closed state, and when the solenoid is turned to a magnetized state, the fixed, closed state of the shutter is released and an open state of the shutter can be generated by operating the lock member moving device (e.g., a lock key).

In a further preferred embodiment of the card cassette device according to the first aspect of the present invention, the lock member (e.g., a lock plate) comprises a cam part having a predetermined cam function which is generated by engagement of the lock member with the lock member engaging hole (e.g., an engaging hole) of the shutter.

In a further preferred embodiment of the card cassette device according to the first aspect of the present invention, the lock member comprises a cam part having a predetermined cam function which is generated by engagement of the lock member with the lock member engaging hole of the shutter, wherein the shutter is moved due to the cam function of the cam part, thereby opening the card outlet.

In a further preferred embodiment of the card cassette device according to the first aspect of the present invention, the lock member comprises a cam part having a predetermined cam function which is generated by engagement of the lock member with the lock member engaging hole of the shutter, wherein the cam part is slid with an inner edge of the lock member engaging hole, thereby moving the shutter to open the card outlet.

In a further preferred embodiment of the card cassette device according to the first aspect of the present invention, a lock key is provided on the body as the lock member moving device, wherein the lock key is operable from the outside of the body.

In a further preferred embodiment of the card cassette device according to the first aspect of the present invention, the shutter is biased in a direction of closing the card outlet by a biasing device (e.g., a spring), and the lock member moving device (e.g., a lock key) moves the shutter against a biasing force of the biasing device.

In a further preferred embodiment of the card cassette device according to the first aspect of the present invention, the stopper member moving device (e.g., a solenoid) is placed at an unreacheable position from the outside in the body.

According to the second aspect of the present invention, a card dispensing apparatus is provided, which comprises:

a main unit having a function of feeding cards in a predetermined direction;

a card cassette device for storing cards therein, wherein the card cassette device is detachably mounted on the main unit;

a first controller provided in the main unit;

a body provided in the card cassette device, wherein the body has a storing section for storing cards and a card outlet for sending out the cards, and the storing section is formed in the body and the card outlet is formed in a front part of the body;

a shutter for opening and closing the card outlet, wherein the shutter is movable along the front part of the body;

a shutter fixing mechanism provided in the card cassette device, wherein the shutter fixing mechanism fixes the shutter in its closed state;

an open state locking mechanism provided in the card cassette device, wherein the open state locking mechanism cancels the closed state of the shutter and locks the shutter in its open state;

a second controller provided in the card cassette device, wherein the second controller controls activation and deactivation of the shutter fixing mechanism;

data lines for electrically interconnecting the first controller and the second controller to enable communication therebetween when the card cassette device is mounted on the main unit; and an identification information storing device provided in the card cassette device, wherein the identification information storing device stores an identification information of the card cassette device;

wherein when the card cassette device is mounted on the main unit, the first controller performs communication with the second controller to verify conformity of the card cassette device mounted based on the identification information of the card cassette device stored in the identification information storing device; and the first controller sends an instruction to deactivate the shutter fixing mechanism to the second controller only when the conformity of the card cassette device mounted is verified.

With the card dispensing apparatus according to the second aspect of the present invention, as explained above, the apparatus is configured to include the main unit having the function of feeding cards in the predetermined direction, and the card cassette device for storing the cards therein which is detachably mounted on the main unit. In the card cassette device, the shutter which is movable along the front part of the body to open and close the card outlet is provided, and the shutter fixing mechanism for fixing the shutter in the closed state thereof is provided. Activation and deactivation of the shutter fixing mechanism is controlled by the second controller provided in the card cassette device.

When the card cassette device is mounted on the main unit, the first controller and the second controller are electrically interconnected by way of the data lines to enable communication therebetween. In this state, the first controller performs communication with the second controller, verifying the conformity of the card cassette device which has been mounted on the main unit using the identification information of the device stored in the identification information storing device.

If the conformity of the card cassette device is verified, the first controller sends the instruction to deactivate the shutter fixing mechanism to the second controller. In response to this instruction, the shutter fixing mechanism is deactivated and therefore, by operating the open state locking mechanism, the closed state of the shutter can be canceled, in other words, the shutter can be opened. This means that the card dispensing operation is possible as desired.

On the other hand, if the conformity of the card cassette device is not verified, the first controller does not send the instruction to deactivate the shutter fixing mechanism to the second controller and therefore, the closed state of the shutter is kept unchanged, in other words, the shutter cannot be opened even if the open state locking mechanism is operated. This means that the card dispensing operation is impossible.

Accordingly, measures for illegally opening the card outlet from the outside can be surely eliminated in the non-mounted state where the card cassette device is not mounted on the main unit. This means that that a higher security level than that of the prior art can be realized with a simple structure.

In addition, in the case where the conformity of the card cassette device is not verified, the shutter fixing mechanism keeps the closed state of the shutter and therefore, non-conformable card cassette devices can be prevented from being used. This means that only the use of a predetermined card cassette device which is conformable to the main unit can be allowed, in other words, the card cassette device and the main unit can be made to have the relationship of one-to-one correspondence.

In a preferred embodiment of the card dispensing apparatus according to the second aspect of the present invention, a data line reference potential changing device for changing a reference potential of the data lines from a first level to a second level which is different from the second level when the card cassette device is mounted on the main unit is provided, wherein if the reference potential of the data lines is at the second level, the first controller judges that the card cassette device is mounted on the main unit.

In another preferred embodiment of the card dispensing apparatus according to the second aspect of the present invention, the first controller monitors a reference potential the data lines on a regular basis, wherein the first controller judges that the card cassette device is not mounted on the main unit if the reference potential of the data lines is changed from the second level to the first level.

In still another preferred embodiment of the card dispensing apparatus according to the second aspect of the present invention, a shutter opening/closing detecting device for detecting an open state and a closed state of the shutter so as to be interlocked with opening and closing of the shutter is provided, wherein the first controller judges that card dispensing is possible if the shutter opening/closing detecting device detects the open state of the shutter.

In a further preferred embodiment of the card dispensing apparatus according to the second aspect of the present invention, the shutter fixing mechanism comprises a stopper member engaging hole formed in the shutter, a stopper member engageable with the stopper member engaging hole, and a stopper member moving device for moving the stopper member and/or the stopper member engaging hole to perform engagement or disengagement of the stopper member with/from the stopper member engaging hole; wherein the stopper member moving device comprises a solenoid configured to be controlled by the second controller in response to an instruction sent from the first controller, and the stopper member is integrated with a rod of the solenoid; and wherein the closed state of the shutter is fixed if the solenoid is not energized, and the fixed, closed state of the shutter is canceled and the shutter is made openable if the solenoid is energized.

BRIEF DESCRIPTION OF THE DRAWINGS

In order that the present invention may be readily carried into effect, it will now be described with reference to the accompanying drawings.

DETAILED DESCRIPTION OF THE INVENTION

Figure 1:
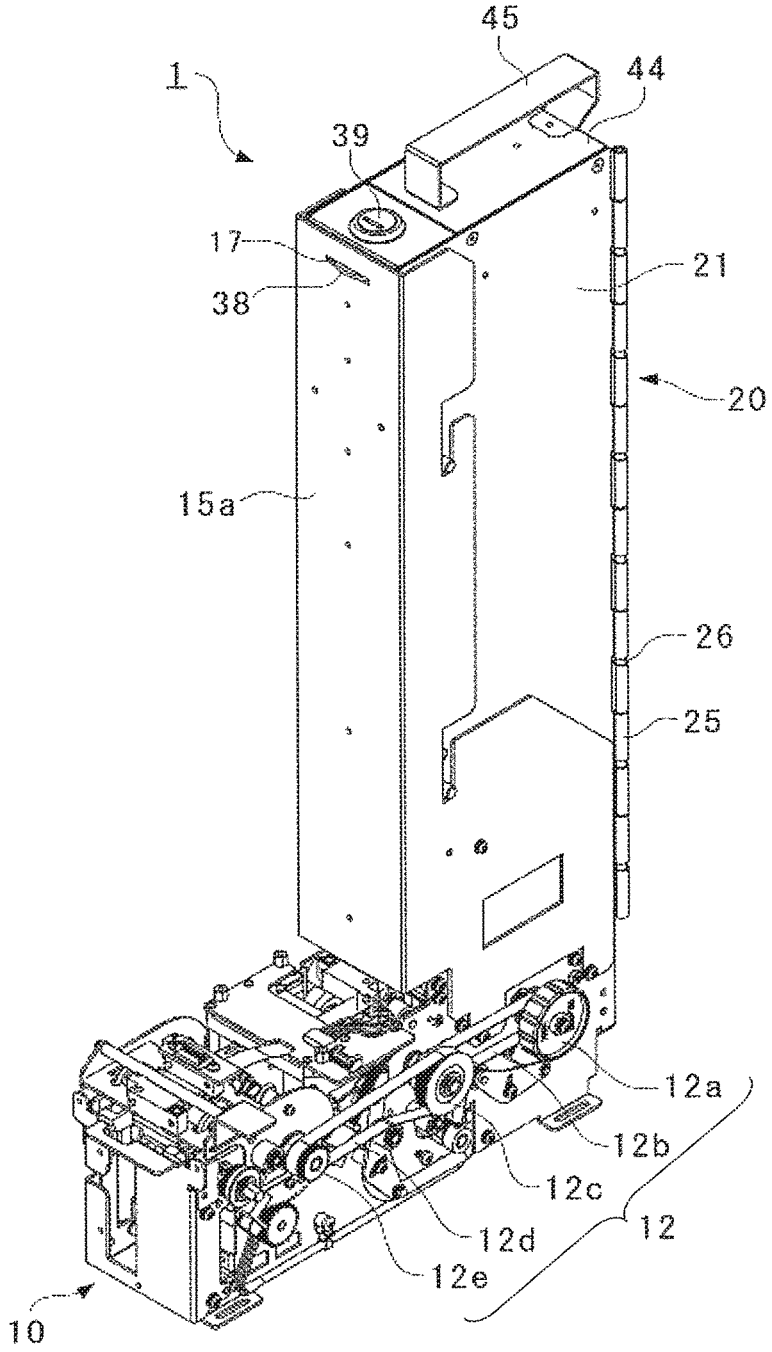
FIG. 1 is a perspective view showing the overall structure of a card dispensing apparatus according to an embodiment of the present invention.

Preferred embodiments of the present invention will be described in detail below while referring to the drawings attached.

[Overall Structure of Card Dispensing Apparatus]

A card dispensing apparatus 1 according to an embodiment of the present invention is shown in FIGS. 1 to 5, into which a card cassette device 20 is incorporated.

As shown in FIGS. 1 to 5, the card dispensing apparatus 1 comprises a main unit 10 that provides the basic structure and the basic functions of the apparatus 1, and the card cassette device 20 having the function of storing a plurality of cards therein. The card cassette device 20 is detachably mounted on the main unit 10.

The main unit 10 comprises a card feeding mechanism 12 provided at its lower part and a cassette installing guide 15 formed at its rear end part in such a way as to be overlaid on the rear end of the mechanism 12. The main unit 10 has the function of taking out one card at the lowest end position from the stack of cards stored in the card cassette device 20, feeding the card thus taken out forward along a predetermined carrying path (not shown), and dispensing the card thus fed to the outside through a card outlet (not shown) formed at the front end of the unit 10.

Here, as clearly shown in FIG. 1, the card feeding mechanism 12 comprises a pulley 12*a* driven by an electric motor (not shown), an endless belt 12*b*, a pulley 12*c*, an endless belt 12*d*, and a pulley 12*e*. In addition, the lowest-positioned card in the stack is introduced into the carrying path using a card feeding roller 12*f* (see FIG. 4) included in the card feeding mechanism 12.

At the rear end of the main unit 10, to facilitate installation of the card cassette device 20, the cassette installing guide 15 is provided. As clearly shown in FIGS. 2 and 3, the guide 15 comprises a front panel 15*a* extending vertically, and a pair of side panels 15*b* which is connected to the two sides of the front panel 15*a* and which has an approximately L-shaped pattern in a horizontal cross section. At the back of these panels 15*a* and 15*b*, in other words, in the inside of the cassette installing guide 15, a recess part 15*c* for receiving the card cassette device 20 is formed. The device 20 is placed into the recess part 15*c* so as to be inserted into the recess part 15*c* from its obliquely upward position and is fitted into the recess part 15*c* to have a state shown in FIG. 1 and then, fixed as it is.

Figure 2:
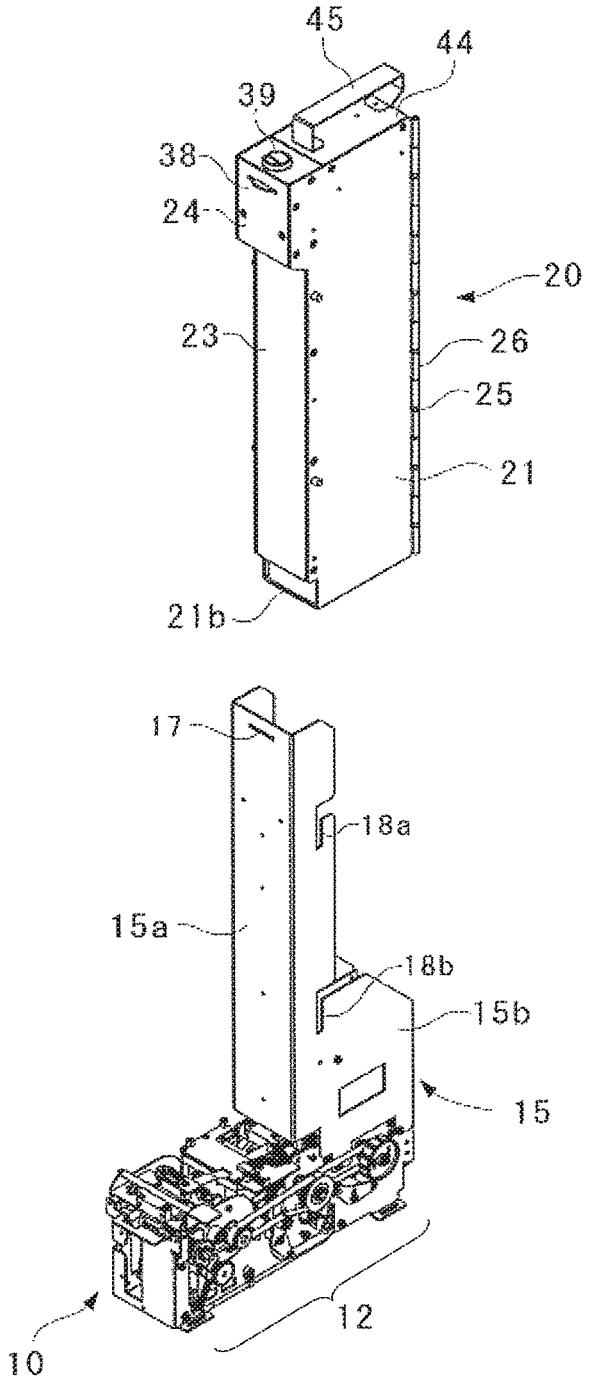
FIG. 2 is a perspective view showing the state where the card cassette device is dismounted from the main unit of the card dispensing apparatus of FIG. 1.
Figure 3:
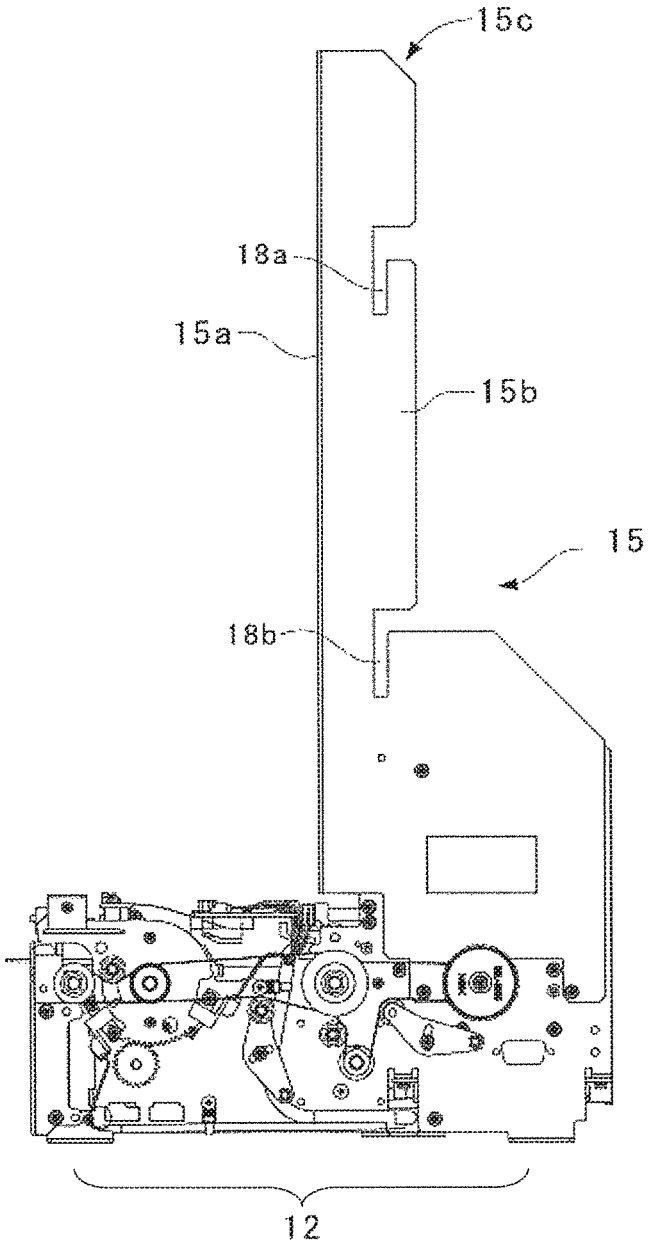
FIG. 3 is a side view showing the state where the card cassette device is dismounted from the main unit of the card dispensing apparatus of FIG. 1.
Figure 4:
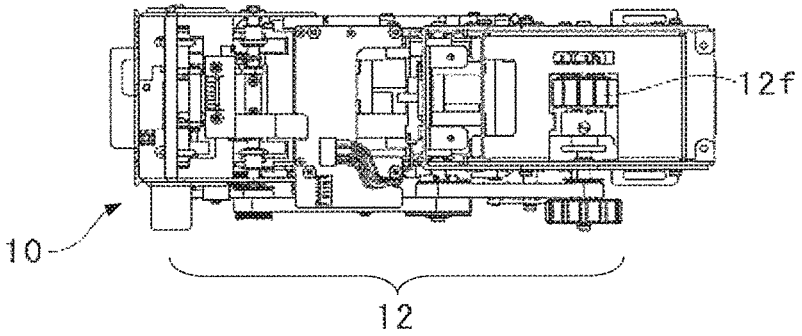
FIG. 4 is a plan view showing the card feeding mechanism provided in the main unit of the card dispensing apparatus of FIG. 1.

In the pair of side panels 15*b*, as clearly shown in FIGS. 2 and 3, a pair of guide grooves 18*a* and 18*b* is formed to have an inverted L-shaped side view. The width of the vertically extending portions of the guide grooves 18*a* and 18*b* is set at a value slightly larger than the diameter of two shafts 34 (see FIG. 11) of the card cassette device 20. Since the ends of the shafts 34 are horizontally protruded from the device 20, the installing or mounting operation of the card cassette device 20 on the main unit 10 is performed by engaging the shafts 34 with the respective guide grooves 18*a* and 18*b*. By such the simple structure as described here, the horizontal displacement of the device 20 is regulated.

On the upper part of the front panel 15*a*, as shown in FIGS. 1 and 2, an engaging hole 17 for a lock plate 38 which will be explained later is formed. The vertical displacement of the card cassette device 20 is regulated by engaging the lock plate 38 with the engaging hole 17. Due to this simple structure, the locked state of the device 20 is generated by engaging the lock plate 38 with the hole 17 in the state where the card cassette device 20 is mounted on the main unit 10. This means that the combination of the lock plate 38 and the engaging hole 17 functions as a locking mechanism for the device 20.

Figure 5:
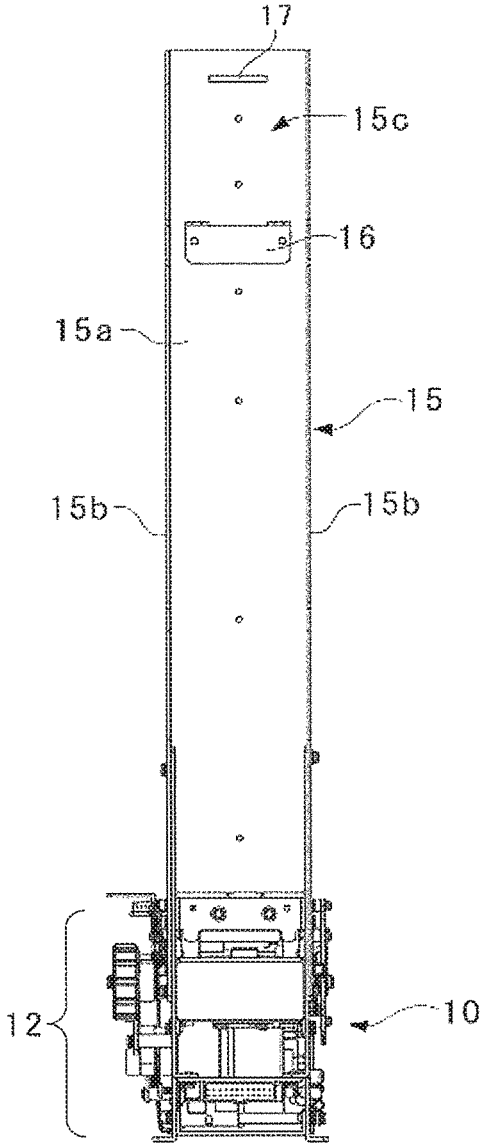
FIG. 5 is a rear view showing the main unit of the card dispensing apparatus of FIG. 1.

On the upper rear part of the front panel 15*a* that forms a part of the cassette installing guide 15, an electrical connector 16 is provided, as shown in FIG. 5. The connector 16 is electrically connected to the card feeding mechanism 12 by way of a harness (not shown). Moreover, the connector 16 is electrically connected to an electrical connector 37 of the card cassette device 20 which will be explained later. By way of these the electrical connections, sending and receiving operations of electric signals between the device 20 and the unit 10 are performed and at the same time, electric power is supplied to the device 20 from the unit 10.

[Overall Structure of Card Cassette Device]

Next, the card cassette device 20 according to the embodiment of the present invention will be explained in detail with reference to FIGS. 6 to 17.

As shown in FIGS. 6 to 10, the external appearance of the card cassette device 20 has a shape like a rectangular parallelepiped as a whole except that the upper part of the front face is slightly protruded forward. In a body 21 of the device 20, which has a shape like a rectangular parallelepiped, a storing section 21*e* for storing a plurality of cards in a vertically stacked form is formed, and a security mechanism for surely preventing the loss and theft of the cards stored in this section 21*e* is further provided. This security mechanism, which will be explained later in detail, includes a shutter 22 with an engaging hole 22*b*, a guide plate 33, a solenoid 30 for driving the guide plate 33, a lock plate 38 for moving the shutter 22 upward and downward in the state where the plate 38 is engaged with the hole 22*b*, and a lock key 39 for operating (turning) the lock plate 38.

Figure 11:
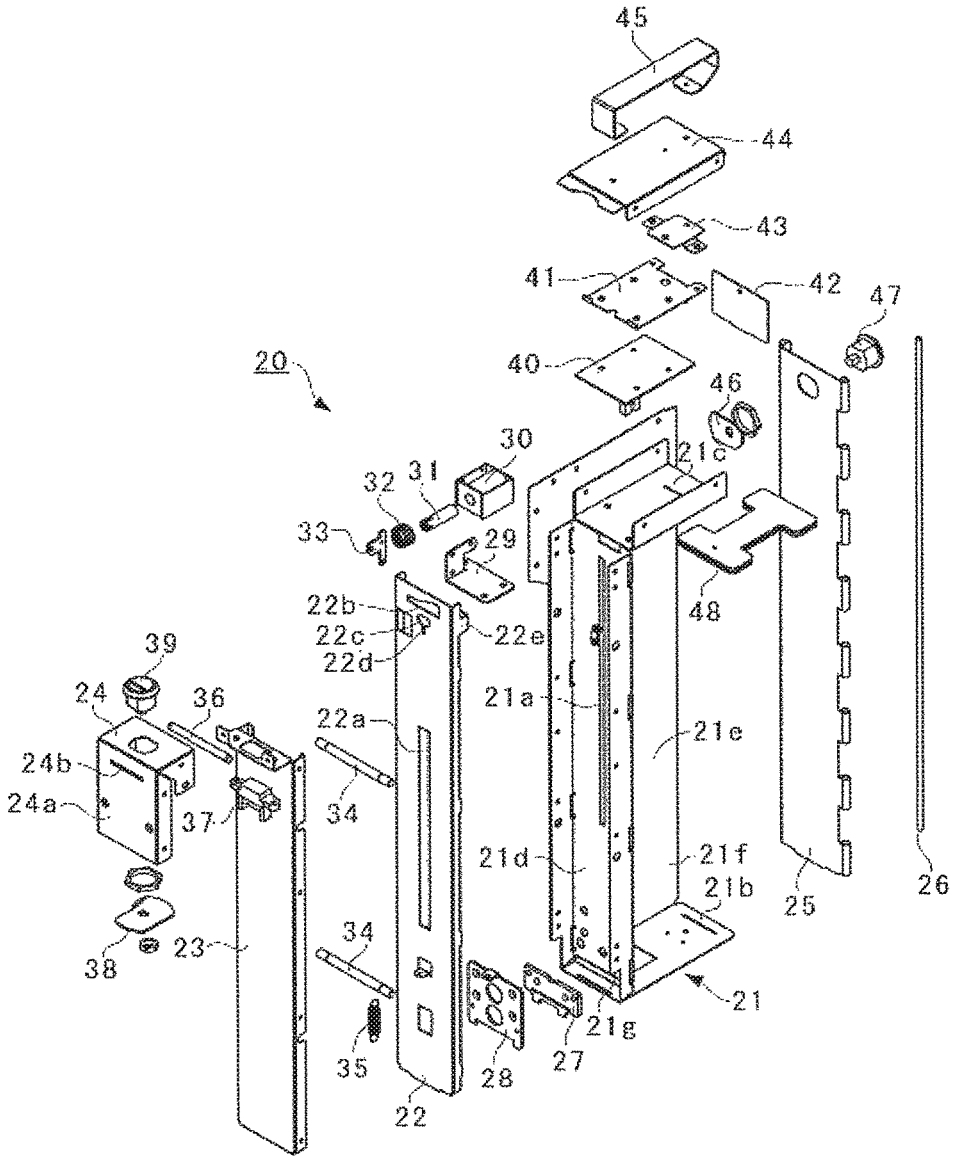
FIG. 11 is an exploded perspective view showing the detailed internal structure of the card cassette device of FIG. 6.

The internal structure of the card cassette device 20 is shown in detail in the exploded perspective view of FIG. 11. Specifically, the card cassette device 20 comprises the body 21 having the storing section 21*e* with a similar shape to a rectangular parallelepiped. The body 21 is constituted by a top part 21*c* and a bottom part 21*b* that form respectively the front face and the bottom face of the storing section 21*e*, a front part 21*d* that forms the front face of the storing section 21*e*, a pair of side parts 21*f* that form respectively the right and left side faces of the section 21*e*, and a door 25 that forms the rear face of the section 21*e*. The door 25 is rotatably attached to the one of the side parts 21*f* with a hinge shaft 26, and the storing section 21*e* can be made accessible from the outside by opening the door 25. A lock key 47 is attached to the door 25. The lock plate 46 for opening and closing the door 25 can be operated by turning the lock key 47 from the outside of the door 25. If the lock key 47 is locked, the door 25 is locked and cannot be opened. If the lock key 47 is released, the door 25 can be made openable.

In the front part 21*d* of the body 21A, a vertically extending slit 21*a* is formed. An opening 21*g* for feeding the cards is formed at the lower end of the front part 21*d*. The opening 21*g* is opened and closed by the shutter 22. In addition, a weight 48, which is located in the storing section 21*e*, is placed on the stack of the cards in the section 21*e*. The weight 48 is used to apply a downward load to the stacked cards in the storing section 21*e*.

A front panel 23, which extends vertically, is fixed to the front part 21*d* of the body 21 in such a way that the shutter 22 with a similar shape is placed between the front panel 23 and the front part 21*d*. The front panel 23 is fixed to the front part 21*d* with the two shafts 34 extending horizontally. By this structure, the shutter 22 can be slid vertically along the front part 21*d* between the front panel 23 and the front part 21*d*. Since a flange is formed at each side of the front part 21*d*, the both side edges of the shutter 22 are guided by the two flanges, thereby realizing a stable sliding operation of the shutter 22. The shutter 22 is always biased or energized downward with a tension spring 35 which is placed between the front panel 23 and the shutter 22. This means that the opening 21*g* located at the front face of the lower end of the body 21 is normally closed by the shutter 22. If the shutter 22 is raised against the resilient force of the spring 35, the opening 21*g* is opened.

Between the front part 21*d* of the body 21 and the shutter 22, a gate mounting plate 28 and a card gate 27 are fixed at a position overlapped with the opening 21*g*. The card gate 27 is fixed on the gate mounting plate 28, and the plate 28 is fixed on the front part 21*d* with screws (not shown). Due to such the structure, a considerably large part of the opening 21*g* of the front part 21*d* is covered with the card gate 27. As a result, a gap that allows one of the cards to pass through is formed at the front face of the lower end of the storing section 21*e*. This gap serves as a card outlet 27*a* which is opened and closed by the shutter 22 (see FIG. 15). When the shutter 22 is raised and opened, the cards can be fed one by one through the card outlet 27*a*; however, when the shutter 22 is descended and closed, the cards cannot be fed.

The shutter 22 comprises a slit 22*a* extending vertically at the central part thereof, as clearly shown in FIG. 11. The slit 22*a* is located at a position overlaid on the slit 21*a* formed in the front part 21*d* of the body 21. In the vicinity of the top end of the shutter 22, an engaging hole (a lock plate engaging hole) 22*b*, a rod inserting hole (a stopper member engaging hole) 22*c*, and a guide plate inserting hole 22*d* (a guide plate engaging hole) are formed. The engaging hole 22*b*, the rod inserting hole 22*c*, and the guide plate inserting hole 22*d* play important roles in the aspect of controlling the sliding action of the shutter 22. The functions of these holes 22*b*, 22*c*, and 22*d* will be explained later.

Figure 17A:
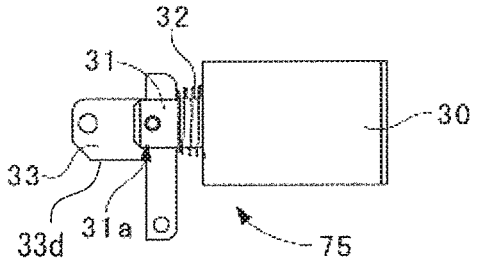
FIGS. 17A to 17C are diagrams showing the structures of the solenoid and the guide plate used in the card cassette device of FIG. 6, respectively.
Figure 17B:
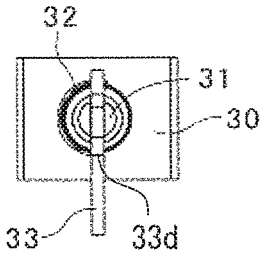
Figure 17C:
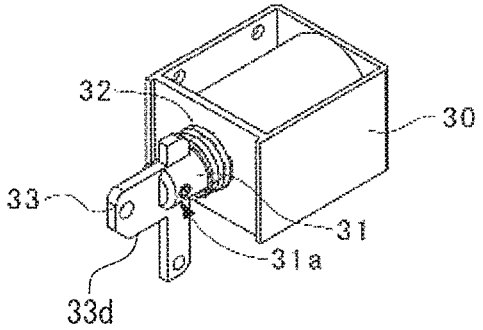

On the upper face of the top part 21*c* of the body 21, a solenoid 30 is mounted using a solenoid bracket 29. As shown in FIG. 17, the guide plate 33, which is formed to have an L-like shape, is fixed to the end 31*a* of the rod 31 of the solenoid 30. A compression spring 32 is fitted to the rod 31 in such a way as to bias or energize the rod 31 in its protruding direction. Therefore, when the solenoid 30 is demagnetized or de-energized, both of the rod 31 and the guide plate 33 are kept in the protruded state; and as long as the solenoid 30 is magnetized or energized, the rod 31 is retracted into the body of the solenoid 30 and the guide plate 33 is drawn toward the body thereof. This means that both of the rod 31 and the guide plate 33 are turned into the retracted state.

Figure 6:
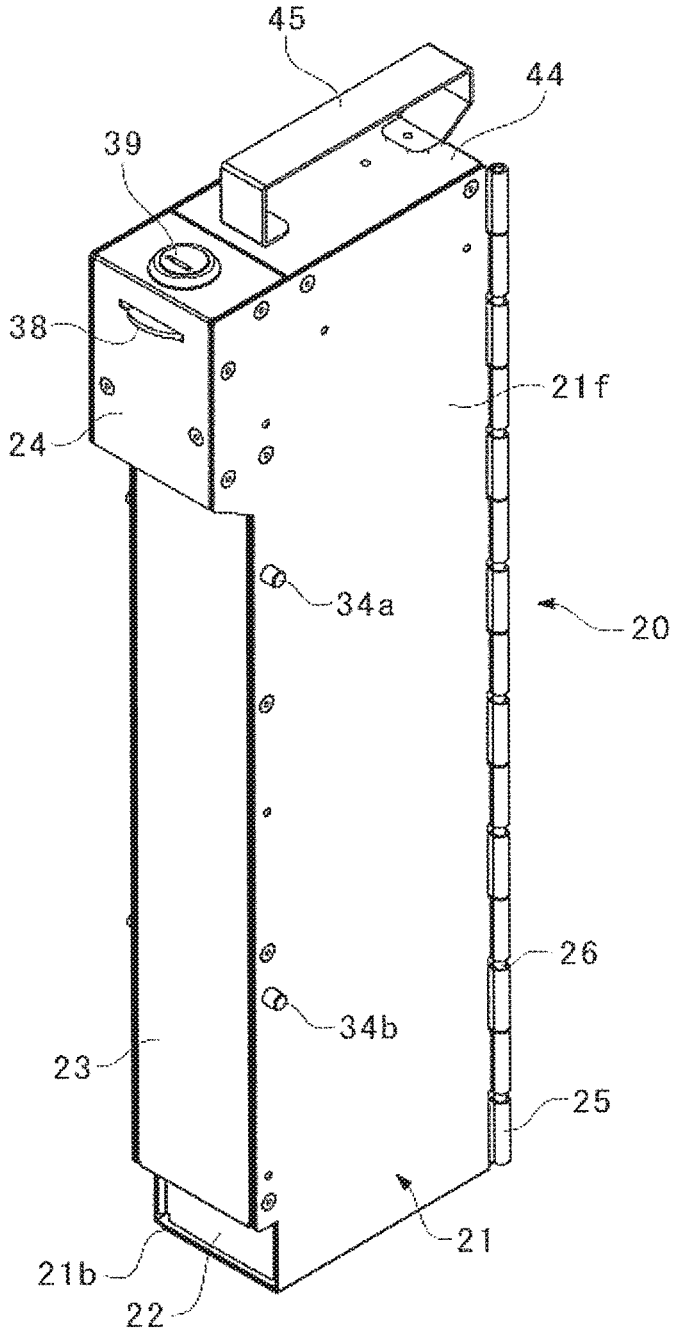
FIG. 6 is a perspective view showing the overall structure of the card cassette device, which is detachably mounted on the main unit of the card dispensing apparatus of FIG. 1.
Figure 7:
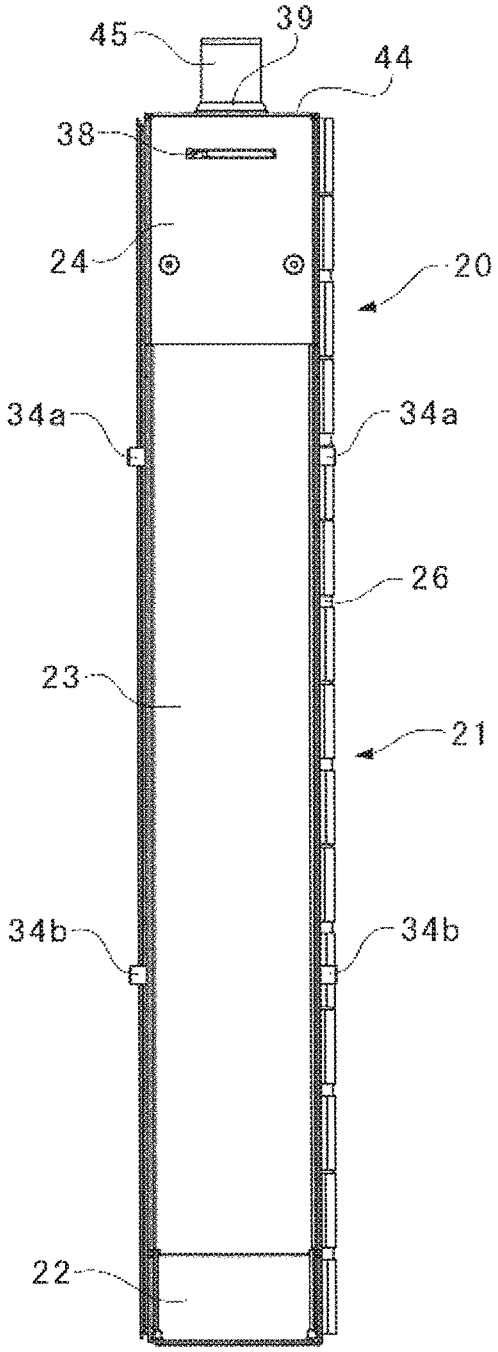
FIG. 7 is a front view of the card cassette device of FIG. 6.
Figure 8:
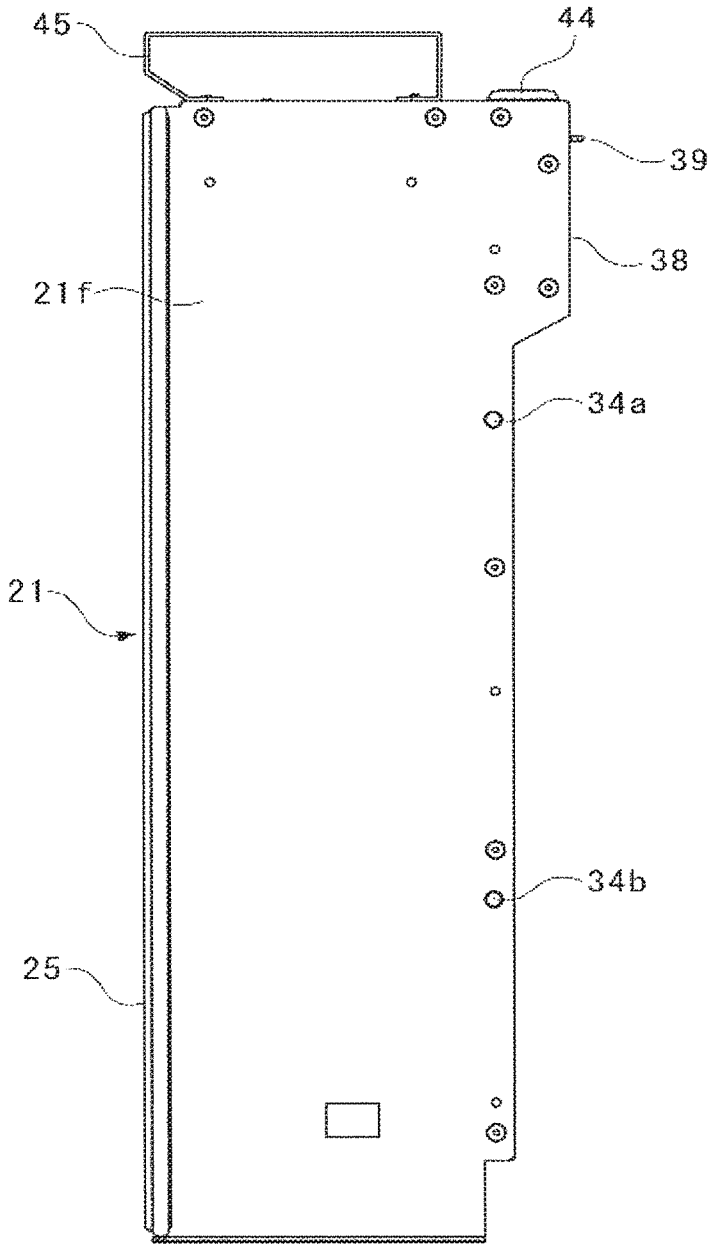
FIG. 8 is a left side view of the card cassette device of FIG. 6.
Figure 9:
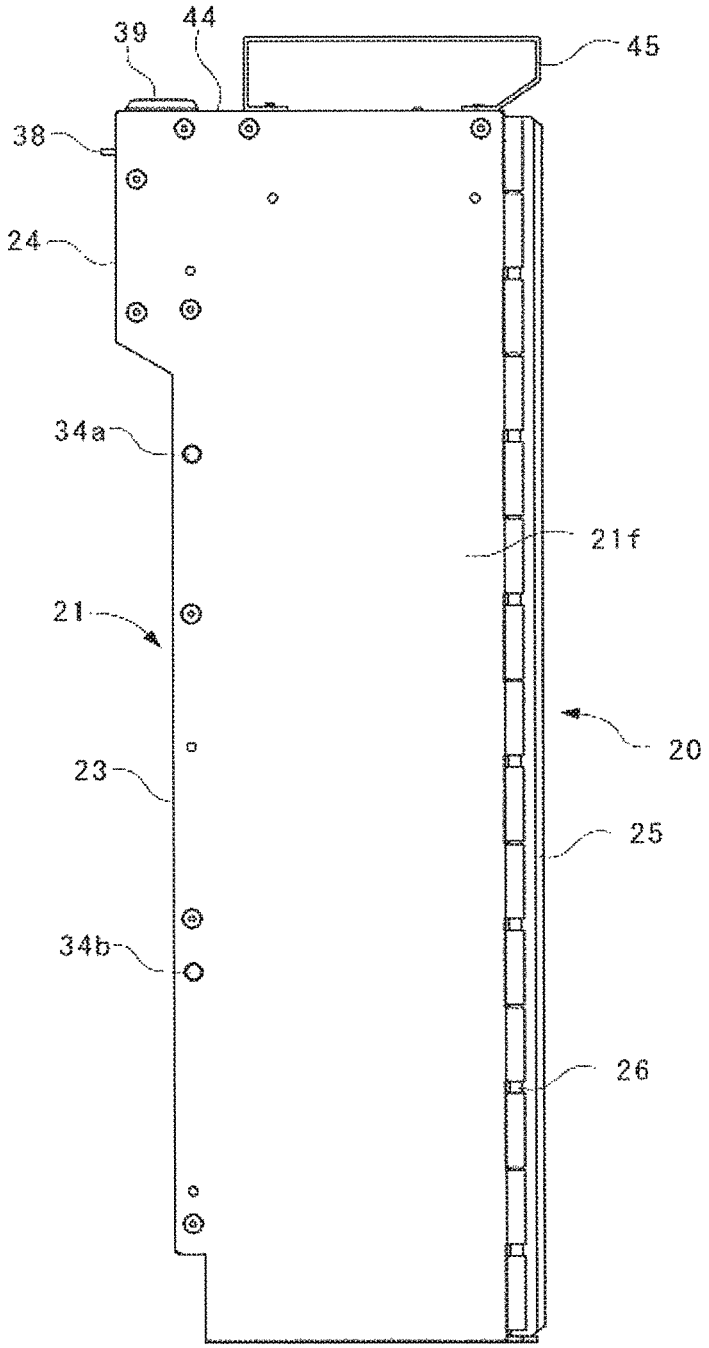
FIG. 9 is a right side view of the card cassette device of FIG. 6.

At the back of the solenoid 30, a control board 40 for controlling the actions of the solenoid 30 and the card cassette device 20 is mounted on the top part 21*c* of the body 21 using a board mounting plate 41, as shown in FIG. 11. The rear of the control board 40 is covered with an inner cover 42. A stopper plate 43 is provided in the vicinity of the board mounting plate 41. As shown in FIG. 6, these are covered with a top panel 44 and thus, they are not visible from the outside. On the outer face of the top panel 44, a handle 45 is fixed to facilitate attachment and detachment of the card cassette device 20 to the main unit 10.

On the front face of the front panel 23, an upper panel 24 is further fixed. A stopper 36, an electrical connector 37, a lock plate 38, and a lock key 39 are placed in the inside space of the upper panel 24, i.e., between the upper panel 24 and the front panel 23. The head of the lock key 39 is exposed from the upper face of the upper panel 24, which enables the lock key 39 to be operated or turned from the outside of the card cassette device 20. The upper panel 24 covers only the top end region of the front panel 23 in such a way as to protrude forward slightly from the front panel 23. The connector 37 is electrically connected to the control board 40 by way of a harness (not shown).

Figure 10:
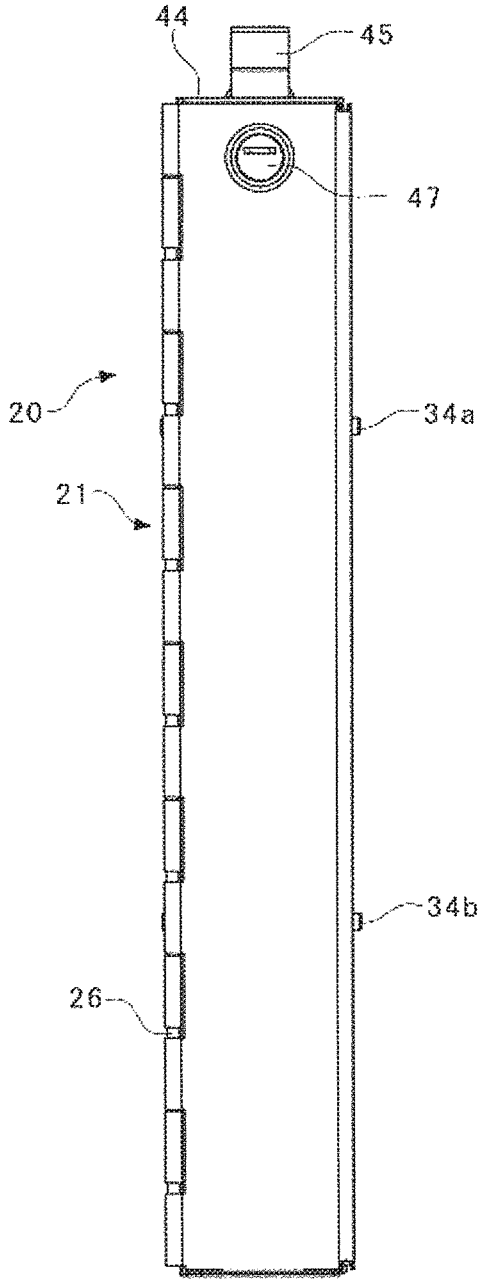
FIG. 10 is a rear view of the card cassette device of FIG. 6.

In this way, the card cassette device 20 has the aforementioned structure. The external appearance of the device 20 is shown in FIGS. 6 to 10. As shown in FIG. 6, only the lower end portion of the shutter 22 is exposed forward from the lower end of the front panel 23. As shown in FIG. 10, the lock key 47 is exposed from the rear face of the device 20, which enables a person or staff to control the opening and closing of the door 25 from the outside. As shown in FIG. 6, the lock key 39 is exposed from the upper face of the device 20, which enables a person or staff to control the opening and closing of the shutter 22 from the outside.

[Function of Engaging Hole of Shutter]

Next, the function of the engaging hole 22*b* of the shutter 22 will be explained below with reference to FIG. 30.

Figure 30:
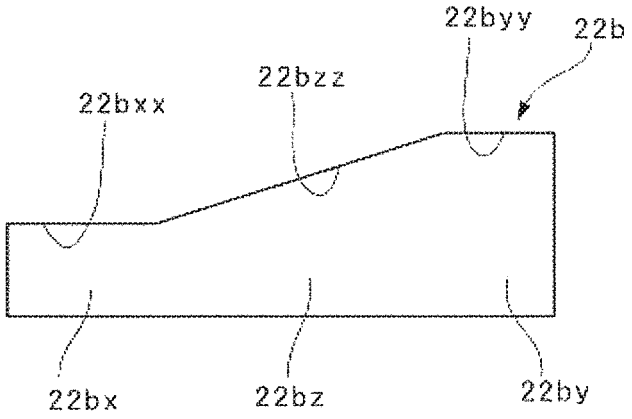
FIG. 30 is a detailed schematic view showing the structure of the engaging hole (lock plate engaging hole) formed in the shutter of the card cassette device of FIG. 6.

As clearly shown in FIG. 30, the engaging hole 22*b* of the shutter 22 does not have a simple rectangular shape but has a shape one end of which is relatively smaller in height (i.e., thinner) and the other end of which is relatively larger in height (i.e., thicker). In other words, a thin or narrow portion 22*bx* whose height (or thickness) is relatively smaller is formed at one end (the left end in FIG. 30) of the hole 22*b*, and a thick or wide portion 22*by* whose height (or thickness) is relatively larger is formed at the other end (the right end in FIG. 30) thereof. An intervening portion 22*bz* interconnecting the thin and thick portions 22*bx* and 22*by* is formed between these two portions 22*bx* and 22*by*. The upper edge and the lower edge of the intervening portion 22*bz* are not the same in shape. That is, the lower edge of the intervening portion 22*bz* extends horizontally over the full length of the engaging hole 22*b*; on the other hand, the upper edge 22*byy* of the thick portion 22*by* extends horizontally, the upper edge 22*bzz* of the intervening portion 22*bz* extends obliquely downward to the thin portion 22*bx* from the thick portion 22*by*, and the upper edge 22*bxx* of the thin portion 22*bx* extends again horizontally.

In this way, the engaging hole 22*b* of the shutter 22 is divided into three portions, i.e., the thin portion 22*bx* which has a relatively smaller thickness and which is formed at one end of the hole 22*b*, the thick portion 22*by* which has a relatively larger thickness and which is formed at the other one end thereof, and the intervening portion 22*bz* formed between the thin and thick portions 22*bx* and 22*by*. Since the intervening portion 22*bz* has the inclined upper edge 22*bzz*, it may be termed the "inclined edge portion".

Because of the aforementioned shape of the engaging hole 22*b*, a cam function can be given to (part of) the lock plate 38 and a cam groove function can be given to the engaging hole 22*b*. Therefore, the shutter 22 can be displaced or slid vertically due to the movement of the lock plate 38 within the hole 22*b*.

The cam function of the lock plate 38 and the cam groove function of the engaging hole 22*b* will be explained in detail later with reference to FIGS. 18 to 29.

[Functions of Rod Inserting Hole, Guide Plate Inserting Hole, and Guide Plate]

Next, the functions of the rod inserting hole 22*c*, the guide plate inserting hole 22*d*, and the guide plate 33 will be explained below with reference to FIGS. 11, 12, and 17.

Figure 12:
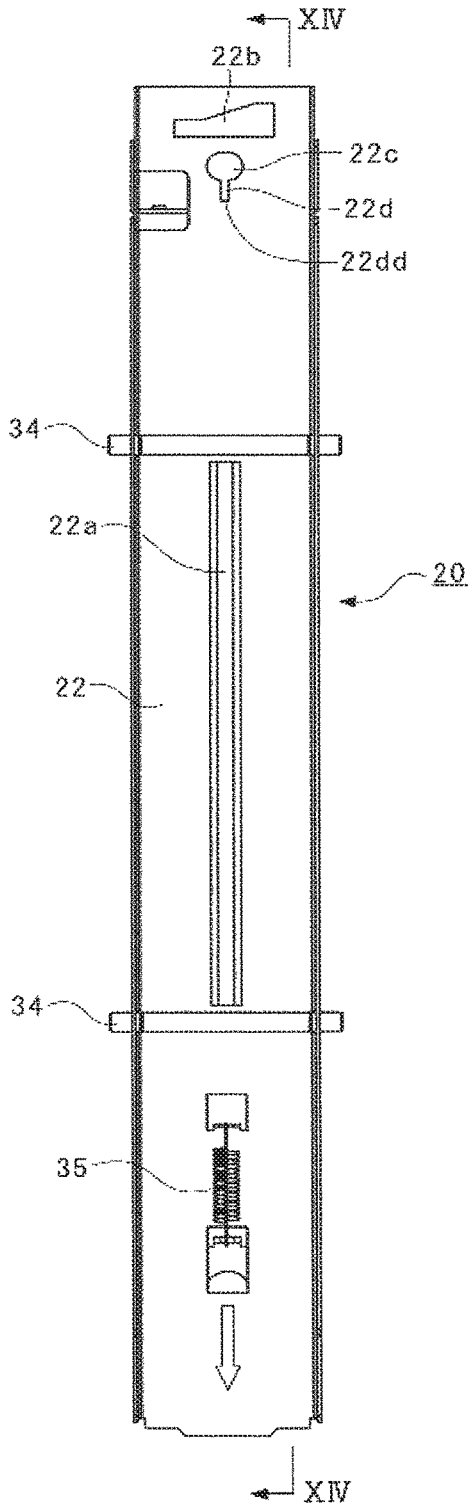
FIG. 12 is a front view showing the main part of the card cassette device of FIG. 6.

As shown in FIG. 12, at a position just below the engaging hole 22*b* of the shutter 22, the circular rod inserting hole 22*c* and the linear guide plate inserting hole 22*d* are formed. The rod inserting hole 22*c* and the guide plate inserting hole 22*d* are connected to each other, joining the top end of the guide plate inserting hole 22*d* to the lower middle edge of the rod inserting hole 22*c*.

The rod inserting hole 22*c* is a circular hole into or from which the end 31*a* of the end 31*a* of the rod 31 of the solenoid 30 is inserted or extracted. The guide plate inserting hole 22*d* is a linear hole into which the engaging part of the guide plate 33 fixed to the rod 31 is inserted. Since the rod inserting hole 22*c* has a circular shape whose diameter is larger than the width of the guide plate inserting hole 22*d*, the engaging part of the guide plate 33 can be moved in both the rod inserting hole 22*c* and the guide plate inserting hole 22*d* in accordance with the vertical movement of the shutter 22. Since the guide plate inserting hole 22*d* is extended vertically and the engaging part of the guide plate 33 is fitted therein, the guide plate 33 has the function of smoothly guiding the vertical movement of the shutter 22.

Figure 18:
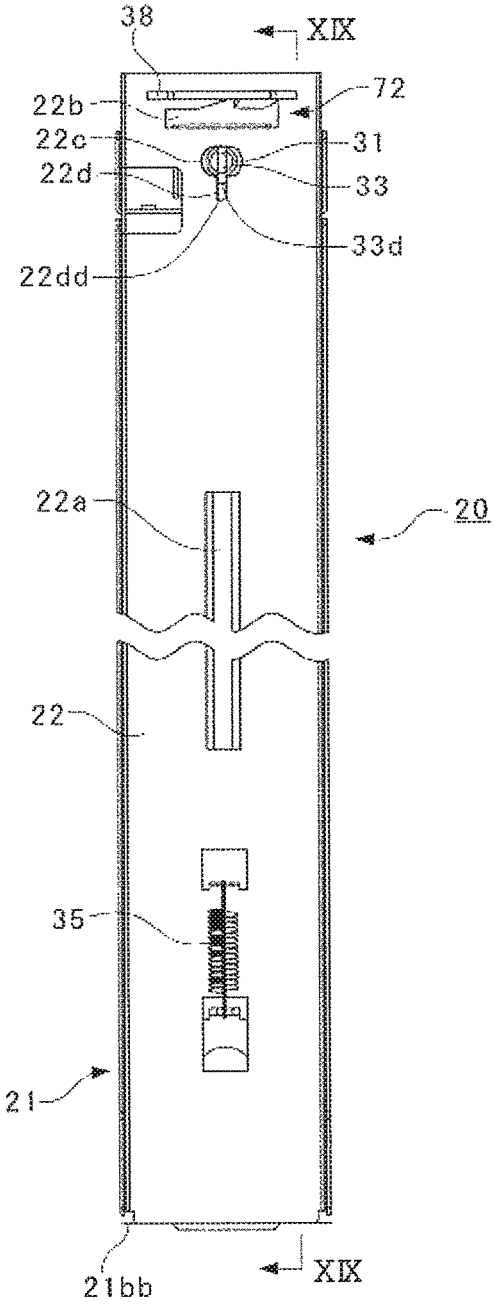
FIG. 18 is a partial front view showing the shutter opening operation of the card cassette device of FIG. 6, in which the card cassette device is not mounted on the main unit of the card dispensing apparatus of FIG. 1.
Figure 19:
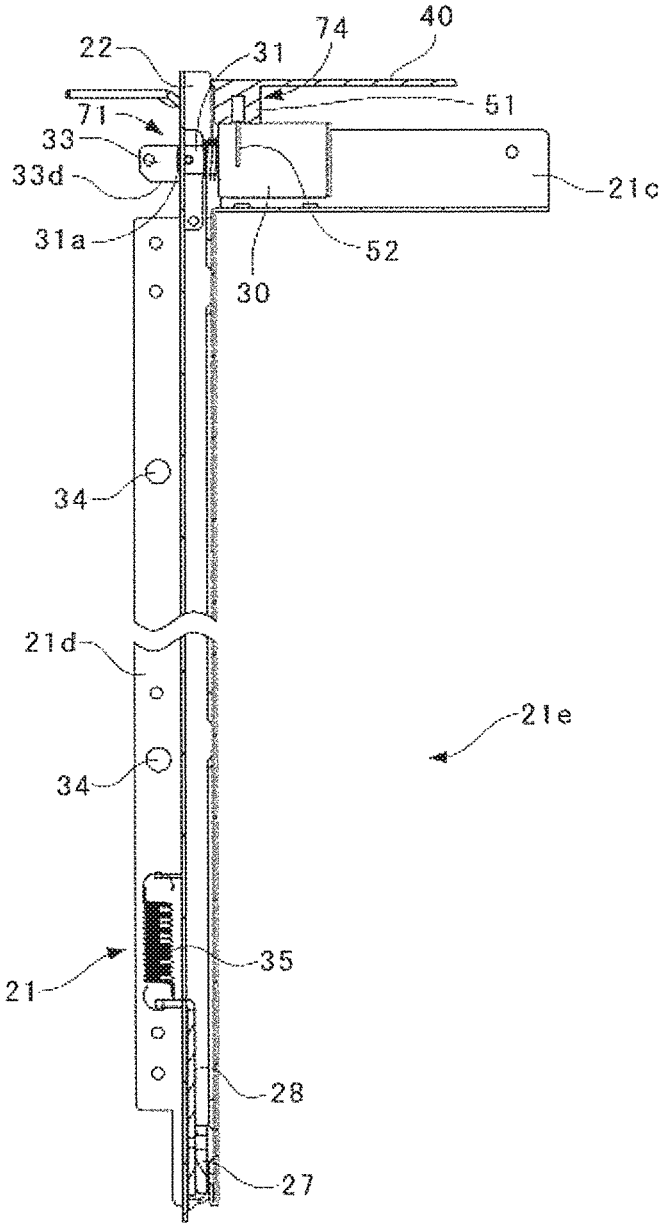
FIG. 19 is a cross-sectional view along the line XIX-XIX in FIG. 18.

When the rod 31 of the solenoid 30 is in the protruded state, the end 31*a* of the rod 31 is engaged with the rod inserting hole 22*c* and at the same time, the guide plate 33 is engaged with the guide plate inserting hole 22*d*, as shown in, for example, FIGS. 17 to 19. In this state, the bottom 33*d* of the engaging part of the guide plate 33 abuts on the bottom 22*dd* of the guide plate inserting hole 22*d* and therefore, the shutter 22 will never be raised and opened even if a person tries to raise the shutter 22.

Figure 24:
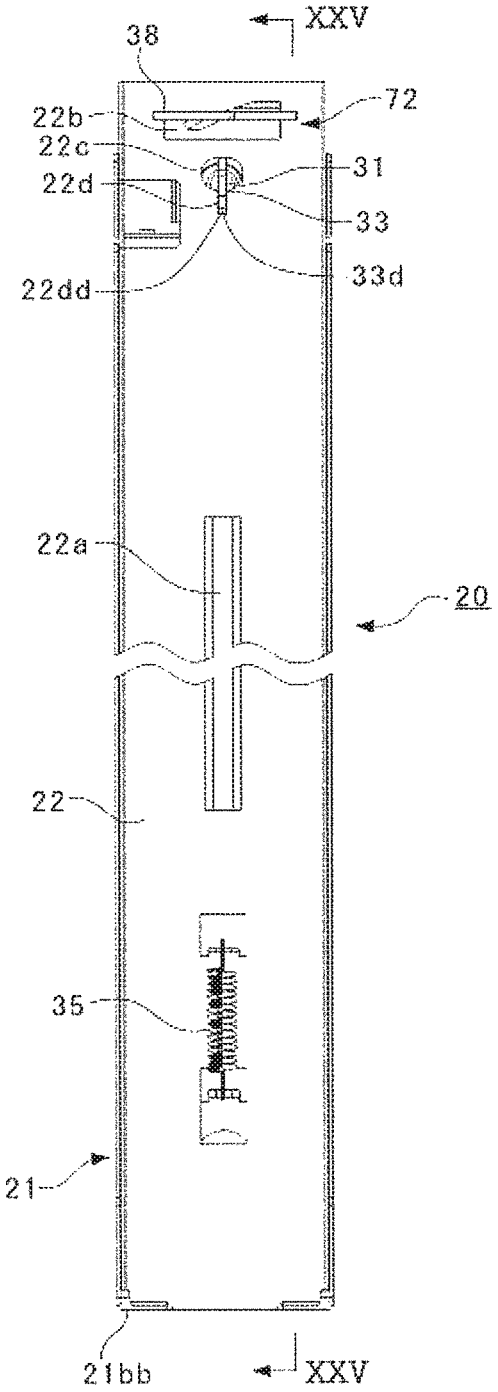
FIG. 24 is a partial front view showing the shutter opening operation of the card cassette device of FIG. 6, in which the state at the start of movement of the shutter is shown.
Figure 25:
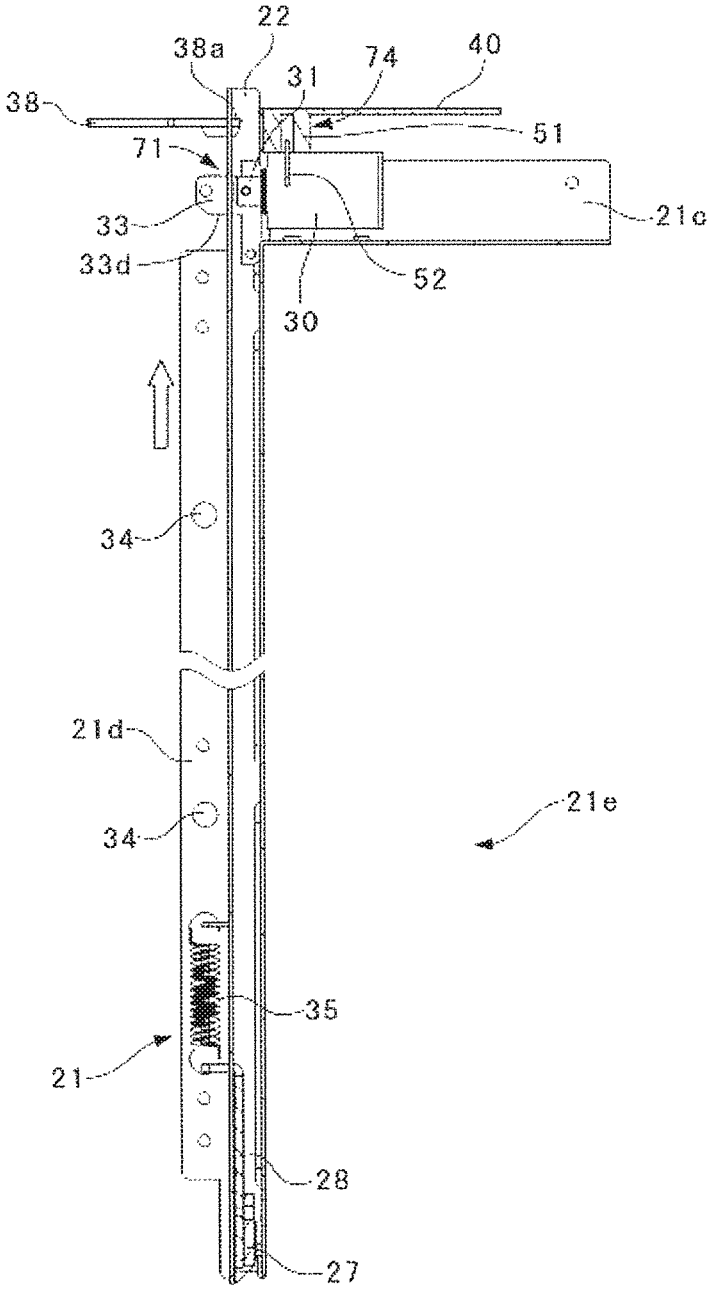
FIG. 25 is a cross-sectional view along the line XXV-XXV in FIG. 24.

On the other hand, when the rod 31 is in the retracted state, the end 31*a* of the rod 31 is disengaged from the rod inserting hole 22*c* but the engaging part of the guide plate 33 is kept engaged with the guide plate inserting hole 22*d*, as shown in, for example, FIGS. 24 and 25. In this state, the shutter 22 can be raised and opened until the bottom 33*d* of the guide plate 33 abuts on the bottom end 22*dd* of the guide plate inserting hole 22*d*. At this time, since the engaging part of the guide plate 33 is kept engaged with the guide plate inserting hole 22*d*, this engaging part is relatively moved along the hole 22*d* in accordance with the rising movement of the shutter 22.

[Detection of Opening/Closing of Shutter]

The aforementioned opening and closing operations of the shutter 22 is detected in the following way.

Figure 13:
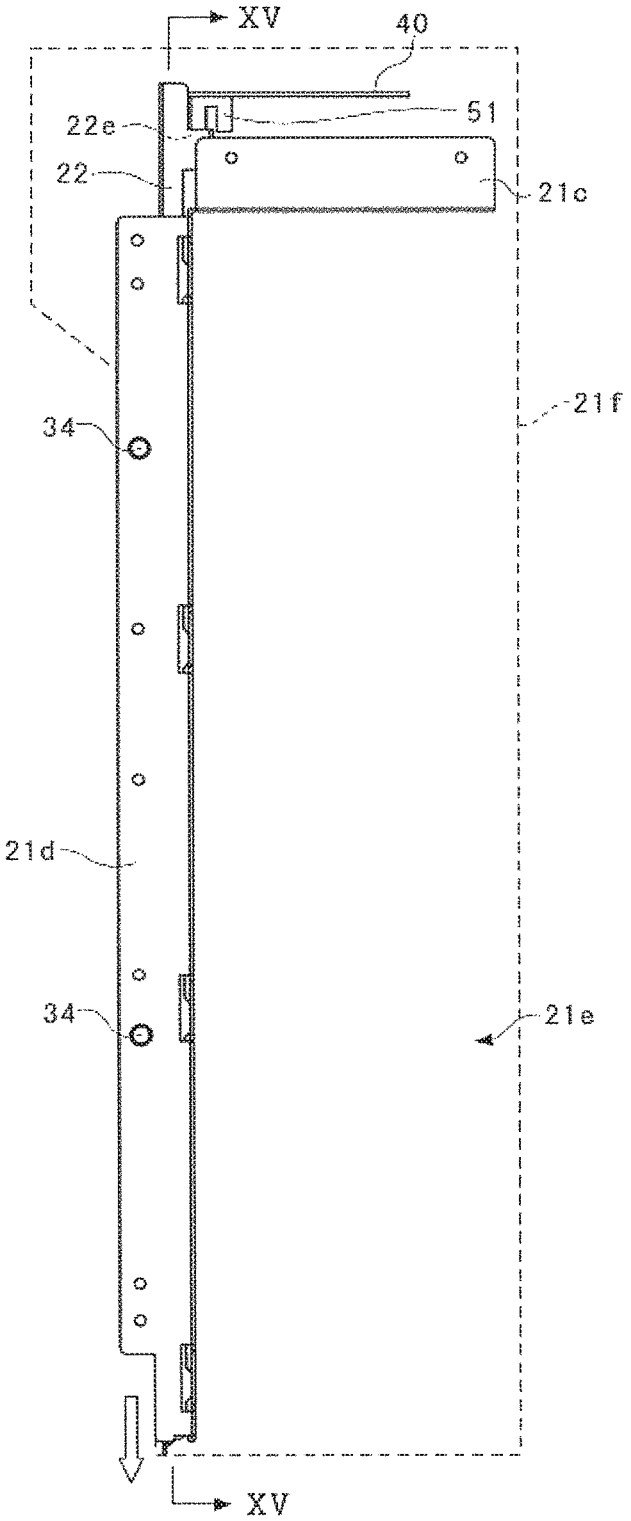
FIG. 13 is a right side view showing the main part of the card cassette device of FIG. 6.
Figure 14:
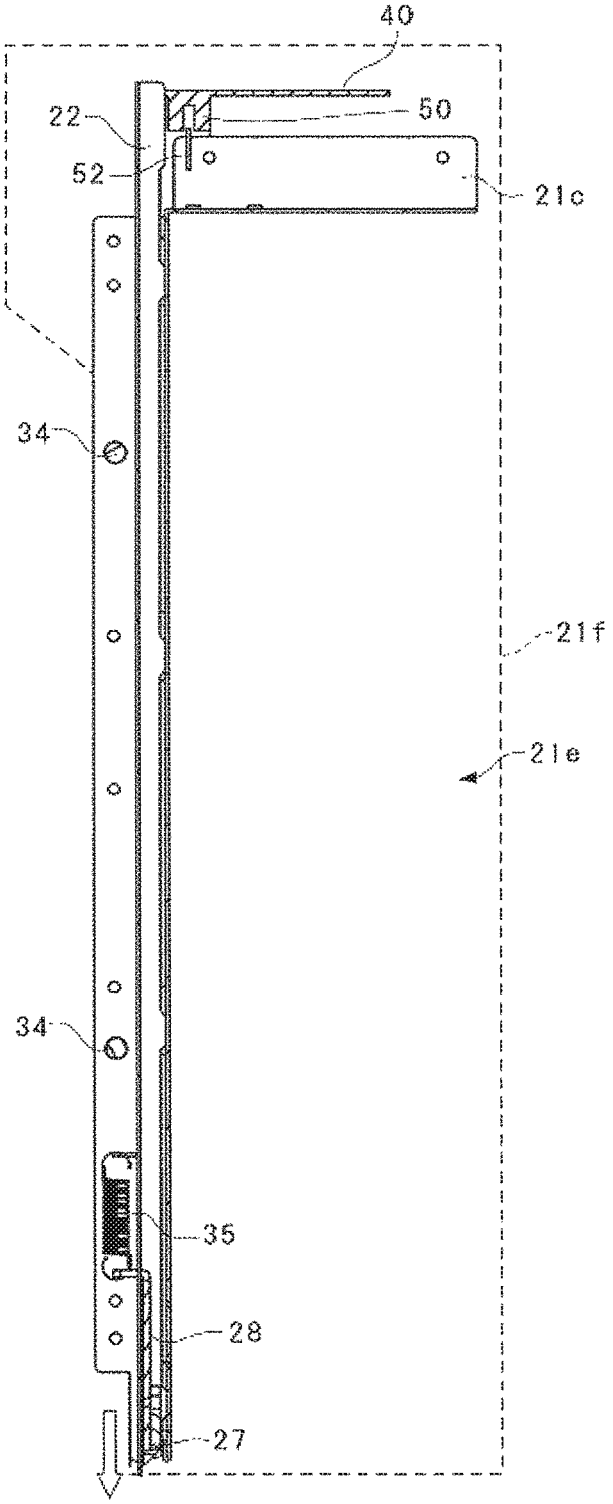
FIG. 14 is a cross-sectional view along the line XIV-XIV in FIG. 12.
Figure 15:
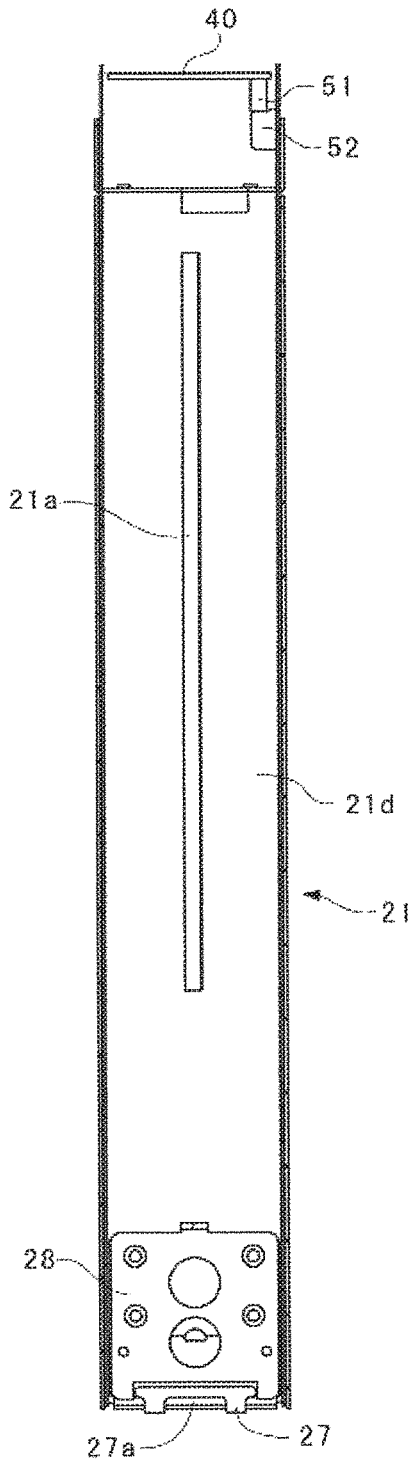
FIG. 15 is a cross-sectional view along the line XV-XV in FIG. 13.
Figure 16A:
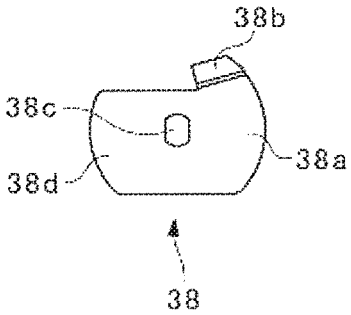
FIGS. 16A to 16F are diagrams showing the structures of the lock plate used in the card cassette device of FIG. 6, respectively.
Figure 16B:
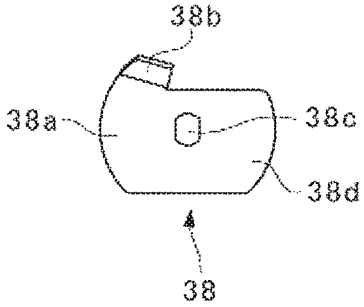
Figure 16C:
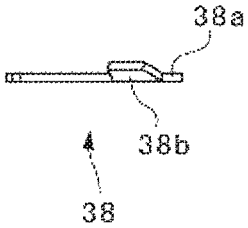
Figure 16D:
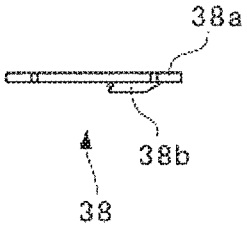
Figure 16E:
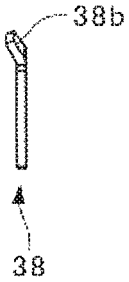
Figure 16F:
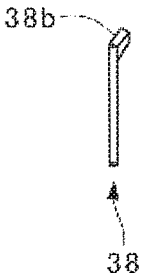

As shown in FIGS. 13 to 15, a photoelectric sensor 51 and a detection piece 52 are provided on the control board 40 which is mounted on the upper part 21*c* of the body 21. The sensor 51 and the piece 52 are used for detecting the position (i.e., vertical movement, opening and closing) of the shutter 22. The combination of the sensor 51 and the piece 52 functions as a shutter opening/closing detecting device 74.

A detection light is irradiated from the photoelectric sensor 51 toward the detection piece 52 at all times during the operation. The sensor 51 detects the intensity change of the reflected light of the detection light by the piece 52, thereby finding the position or movement of the shutter 22. For this purpose, a horizontally extending protrusion 22*e* is formed on the top end of the shutter 22, as shown in FIGS. 11 and 13. If the shutter 22 is in the closed state, the protrusion 22*e* is located below the detection region of the sensor 51 and does not intercept the detection light. However, if the shutter 22 is raised to open the card outlet 27*a* formed at the lower end of the body 21, the protrusion 22*e* enters the detection region of the sensor 51, thereby intercepting the detection light. As a result, the intensity of the reflected light received by the sensor 51 decreases abruptly. In this way, it is judged whether or not the shutter 22 is raised and the card outlet 27*a* is opened by detecting the intensity change of the reflected light with the sensor 51.

[Function of Lock Plate]

The lock plate 38, which is provided in the inside of the upper panel 24 of the card cassette device 20, is used for locking and unlocking the closed state of the shutter 22. The lock plate 38 has the structure shown in FIGS. 16A to 16F. As shown in FIGS. 16A to 16F, the lock plate 38 has a shape similar to that formed by cutting away the two opposite edges of a circular plate using straight lines. A through hole 38*c* is formed at the center of the plate 38. At one of the two sides thus cut away, a tongue-shaped operating part 38*b* is formed so as to protrude from the corresponding side face. The operating part 38*b* has a thickness that decreases gradually toward its end and is slightly inclined downward with respect the remainder. This is to facilitate insertion and engagement of the operating part 38*b* into/with the engaging hole 22*b* of the shutter 22. Since the end of the lock key 39 is inserted into and fixed to the through hole 38*c*, the lock plate 38 can be operated or turned in a horizontal plane by turning the lock key 39 around its longitudinal axis from the outside of the card cassette device 20.

The lock plate 38 further has a cam part 38*a* formed adjacent to the operating part 38*b*. The upper face of the cam part 38*a* is slidably contacted with the upper edge 22*bxx* of the thin portion 22*bx*, the upper edge 22*bzz* of the inclined edge portion 22*bz*, and the upper edge 22*byy* of the thick portion 22*by* of the engaging hole 22*b* of the shutter 22. Therefore, the cam part 38*a* of the lock plate 38 serves as a cam and the engaging hole 22*b* serves as a cam groove. As a result, the shutter 22 having the engaging hole 22*b* can be raised by turning the lock plate 38 by way of the lock key 39.

Furthermore, the lock plate 38 comprises an engaging piece 38*d* that is engageable with the engaging hole 17 of the main unit 10 (see FIG. 1), in which the engagement piece 38*d* is located at the opposite side to the cam part 38*a* in such a way that the through hole 38*c* intervenes between the cam part 38*a* and the engaging piece 38*d*. The engaging piece 38*d* has the function of preventing the card cassette device 20 from moving vertically in the engaged state of the piece 38*d* with the engaging hole 17 of the main unit 10. This means that the combination of the engaging piece 38*d* and the engaging hole 17 serves as a locking mechanism for locking the mounted state where the card cassette device 20 is mounted on the main unit 10.

[Controllers of Main Unit and Card Cassette Device]

Figure 31:
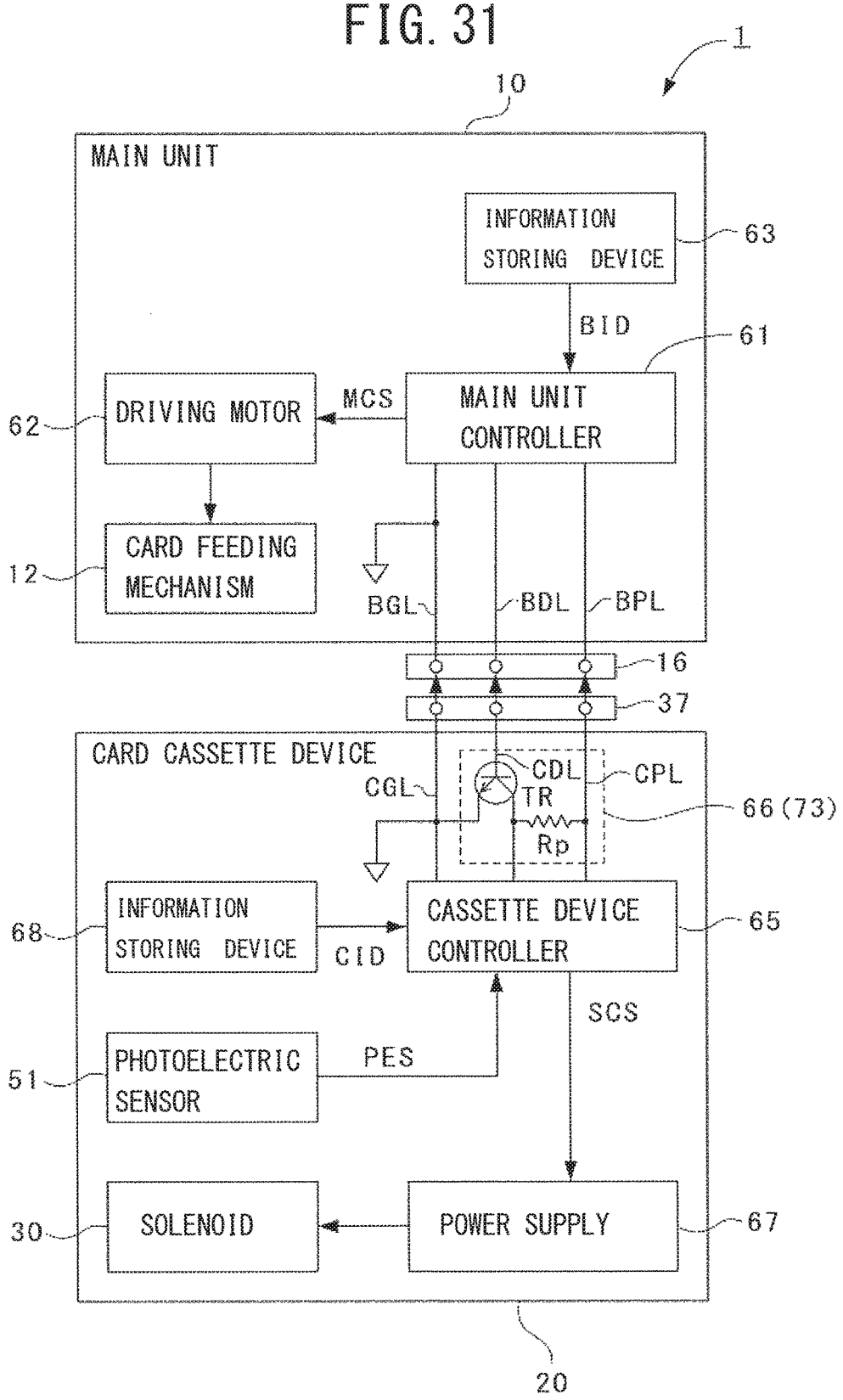
FIG. 31 is a functional block diagram showing the control operation of the card dispensing apparatus of FIG. 1.

Next, a controller of the main unit 10 and a controller of the card cassette device 20 will be explained below with reference to FIG. 31. FIG. 31 is a functional block diagram showing the control operation of the card dispensing apparatus 1.

As shown in FIG. 31, the main unit 10 comprises a main unit controller 61, a card feeding mechanism driving motor 62, and an information storing device 63. The main unit controller 61 controls the operation of the main unit 10 and the communication between the main unit 10 and the card cassette device 20. The card feeding mechanism driving motor 62 drives the card feeding mechanism 12 shown in FIG. 1. The information storing device 63 stores identification (ID) information BID of the main unit 10 itself. This information BID is discrimination information of the card cassette device 20.

The card cassette device 20 comprises a cassette device controller 65, a pull up circuit 66, a solenoid driving power supply 67, and an information storing device 68. The cassette device controller 65 controls the operation of the card cassette device 20. The pull up circuit 66, which comprises an input transistor TR and a pull up resistor Rp, is used to raise the reference potential of data lines BDL and CDL which will be explained later. The solenoid driving power supply 67 supplies an electric power to the solenoid 30, thereby driving the solenoid 30. The information storing device 68 stores identification (ID) information CID of the card cassette device 20 itself. This information CID is discrimination information of the card cassette device 20.

The main unit controller 61 controls the operation of the card feeding mechanism 12 provided in the main unit 10 by outputting a motor control signal MCS to the card feeding mechanism driving motor 62. In the main unit 10, a power supply line BPL, a data line BDL, and a ground line BGL are provided. One end of each of the power supply line BPL, the data line BDL, and the ground line BGL is electrically connected to the main unit controller 61. The other end of each of these lines BPL, BDL, and BGL is electrically connected to the electrical connector 16 shown in FIG. 5. The controller 61 can read out the ID information BID stored in the data storing device 63 as necessary.

On the other hand, in the card cassette device 20, a power supply line CPL, a data line CDL, and a ground line CGL are provided. One end of each of the power supply line CPL, the data line CDL, and the ground line CGL is electrically connected to the electrical connector 37 shown in FIG. 11. The other end of each of the power supply and ground lines CPL and CGL is electrically connected to the cassette device controller 65. The other end of the data line CDL is electrically connected to the base of the transistor TR. The collector of the transistor TR is connected to the controller 65. The pull up resistor Rp is connected between the collector of the transistor TR and the power supply line CPL. The emitter of the transistor TR is connected to the ground line CGL. The transistor TR and the resistor Rp constitute the pull up circuit 66. The cassette device controller 65 controls the operation of the solenoid 30 by outputting a solenoid control signal SCS to the solenoid driving power supply 67. The controller 65 can read out the ID information CID stored in the data storing device 68 as necessary.

If the card cassette device 20 is mounted on the main unit 10, the power supply line BPL, the data line BDL, and the ground line BGL of the main unit 10 are electrically connected to the power supply line CPL, the data line CDL, and the ground line CGL of the card cassette device 20 by way of the connectors 16 and 37, respectively. At this time, the reference potential of the data lines BDL and CDL is changed to the electric potential of the power supply lines BPL and CPL due to the operation of the pull up circuit 66. In other words, the reference potential of the data lines BDL and CDL is changed from the level "L" to the level "H". This means that the pull up circuit 66 functions as a data line reference potential changing device 73 for changing the reference potential of the data lines BDL and CDL.

By detecting the aforementioned reference potential change of the data lines BDL and CDL, the main unit controller 61 can notify the fact that the card cassette device 20 has been mounted on the main unit 10. Moreover, since the main unit controller 61 and the cassette device controller 65 are electrically connected to each other by way of the data lines BDL and CDL, communication between these two controllers 61 and 65 can be made possible by way of the data lines BDL and CDL. The data lines BDL and CDL thus interconnected are used for comparing the ID of the card cassette device 20 with the ID of the main unit 10 by way of the communication between the controllers 61 and 65.

[Operation of Card Cassette Device]

Next, the operation of the card cassette device 20 having the aforementioned structure will be explained below in detail with reference to FIGS. 18 to 29.

Figure 20:
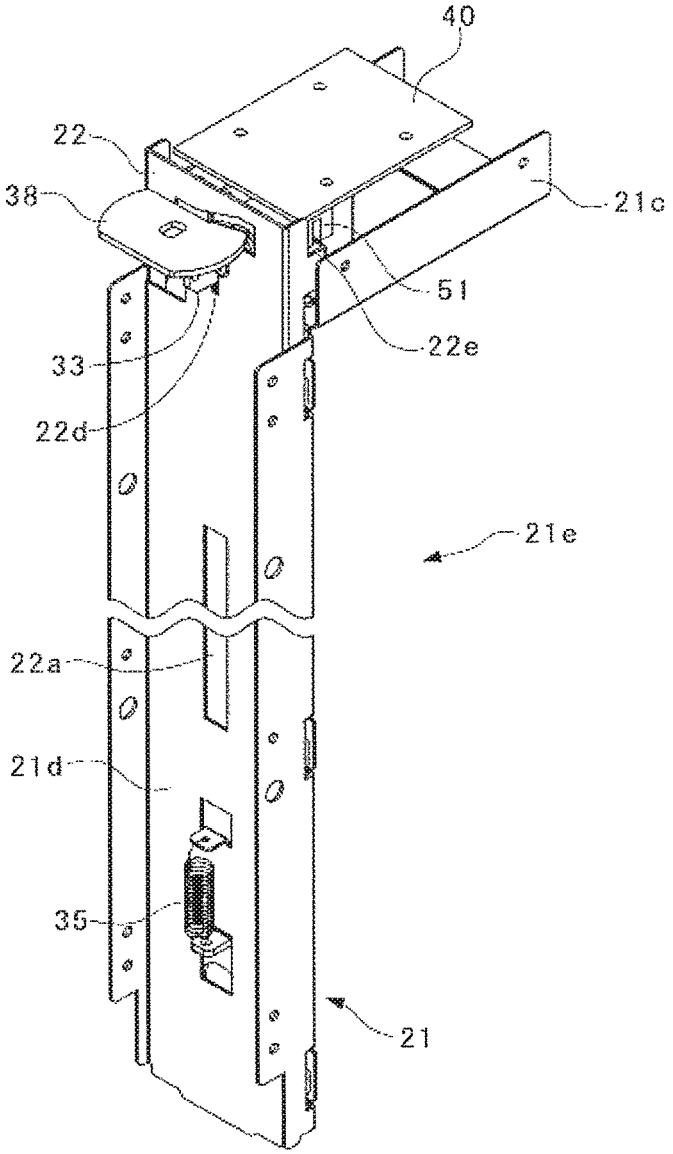
FIG. 20 is a perspective view showing the shutter opening operation of the card cassette device of FIG. 6, in which the card cassette device is not mounted on the main unit of the card dispensing apparatus of FIG. 1.

First, in the state where the card cassette device 20 is not mounted on the main unit 10 of the card dispensing apparatus 1 (i.e., in the non-mounted state), the shutter 22 is kept in the closed state as shown in FIGS. 18 to 20. Specifically, the lower edge of the shutter 22 is in contact with the upper face 21*bb* of the bottom part 21*b* of the body 21, and the card outlet 27*a* formed at the lower end of the front part 21*d* is closed by the card gate 27. At this time, the solenoid 30 is not energized, in other words, the solenoid 30 is in the demagnetized state and therefore, the rod 31 of the solenoid 30 is in the protruded state by the resilient force of the spring 32. In this protruded state, the end 31*a* of the rod 31 is inserted and fitted into the rod inserting hole 22*c* of the shutter 22 and at the same time, the engaging part of the guide plate 33 fixed to the rod 31 is inserted and fitted into the guide plate inserting hole 22*d* of the shutter 22. In this way, the vertical displacement of the shutter 22 is prevented by the engagement of the rod 31 with the rod inserting hole 22*c* and as a result, the shutter 22 is never raised (and therefore, the card outlet 21*g* is never opened) in this non-mounted state.

In this embodiment, the rod 31 of the solenoid 30 serves as the stopper member, the rod inserting hole 22*c* serves as the stopper member engaging hole, and the solenoid 30 and the spring 32 serve as the stopper member moving device. The combination of the stopper member, the stopper member engaging hole, and the stopper member moving device functions as the shutter fixing mechanism 71 for fixing the shutter 22 in its closed state.

In this non-mounting state, only the operating part 38*b* of the lock plate 38 is inserted into the engaging hole 22*b* of the shutter 22, as shown in FIG. 20. However, the operating part 38*b* is positioned in the thick portion 22*by* of the hole 22*b* and therefore, the operating part 38*b* is never contacted with the internal edge of the hole 22*b*. In other words, the operating part 38*b* never applies any force to the shutter 22. For this reason, even if a person tries to operate the lock key 39 from the outside to thereby turn the lock plate 38, he/she cannot open the shutter 22.

On the other hand, if the card cassette device 20 is mounted on the main unit 10 of the card dispensing apparatus 1, the device 20 performs the following operation.

Figure 21:
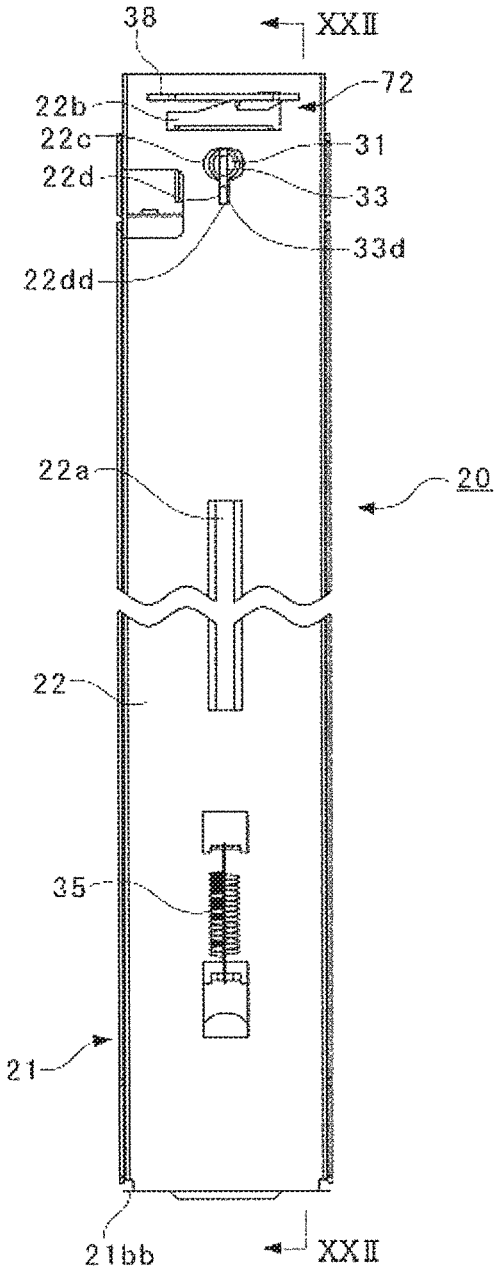
FIG. 21 is a partial front view showing the shutter opening operation of the card cassette device of FIG. 6, in which the card cassette device is mounted on the main unit of the card dispensing apparatus of FIG. 1.
Figure 22:
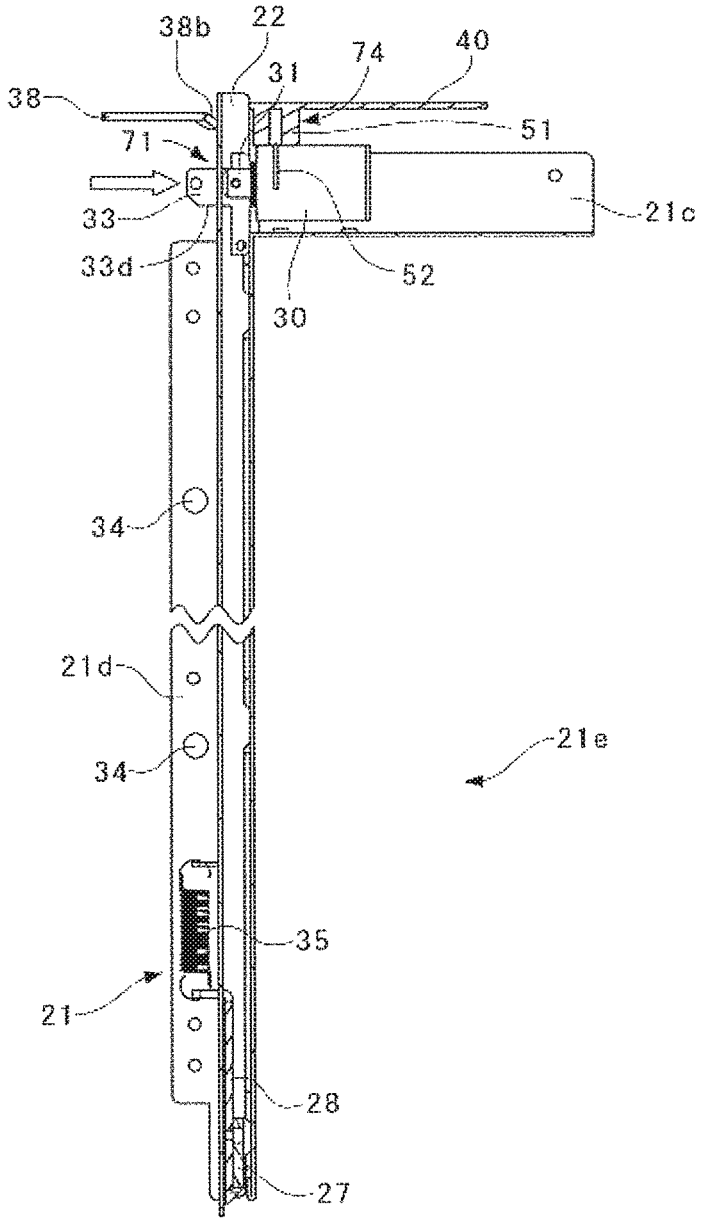
FIG. 22 is a cross-sectional view along the line XXII-XXII in FIG. 21.
Figure 23:
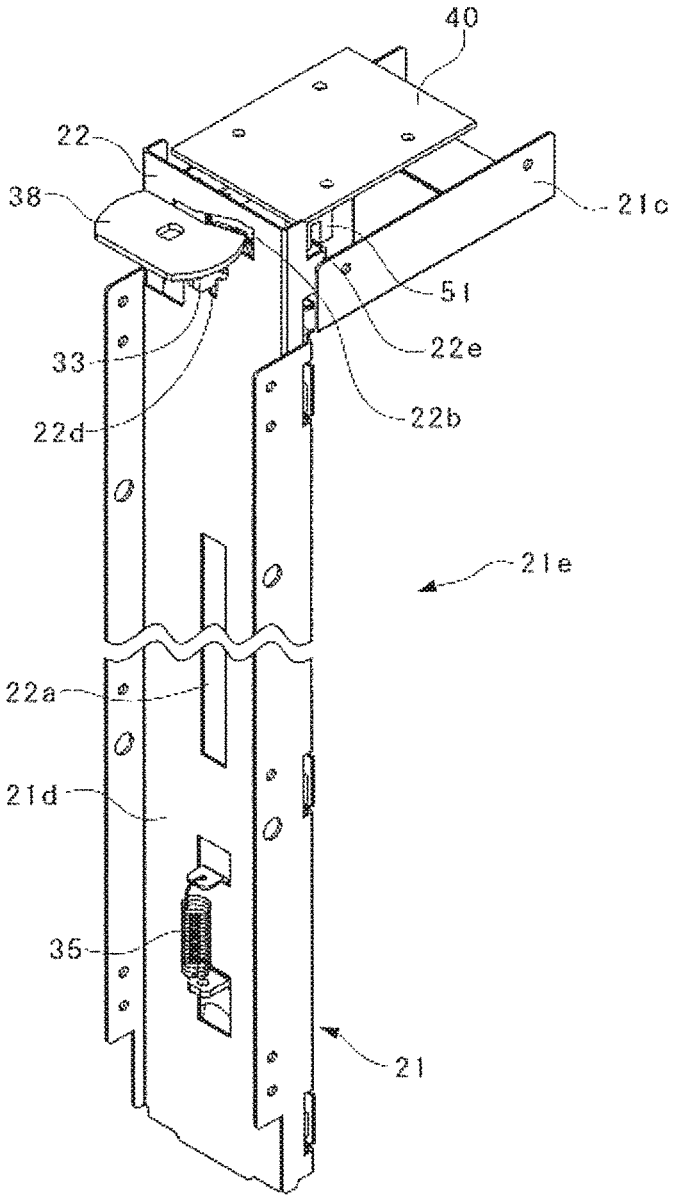
FIG. 23 is a partial front view showing the shutter opening operation of the card cassette device of FIG. 6, in which the card cassette device is mounted on the main unit of the card dispensing apparatus of FIG. 1.

When the card cassette device 20 is mounted on the main unit 10, the device 20 can be supplied with electric power from the main unit 10 and thus, energization of the solenoid 30 becomes possible. Then, the main unit controller 61 (see FIG. 31) provided in the main unit 10 supplies electric power to the solenoid 30, thereby energizing the solenoid 30. In response to this, the solenoid 30 is turned into the magnetized state and the rod 31 of the solenoid 30 is retracted against the resilient force of the spring 32. As a result, almost all of the rod 31 is retracted into the body of the solenoid 30. The state at this time is shown in FIGS. 21 to 23.

When the rod 31 is turned into the retracted state, the end 31*a* of the rod 31 is disengaged from the rod inserting hole 22*c* of the shutter 22. As a result, the engagement between the rod 31 and the hole 22*c* is eliminated, and the shutter 22 is turned to be movable upward. In this retracted state of the rod 31, the state of the lock plate 38 is kept the same as that in the aforementioned non-mounted state. In other words, although only the operating part 38*b* of the lock plate 38 is inserted into the thick portion 22*by* of the engaging hole 22*b*, the operating part 38*b* is not in contact with the internal edge of the hole 22*b*. Therefore, the operating part 38*b* does not apply any force to the shutter 22.

Figure 26:
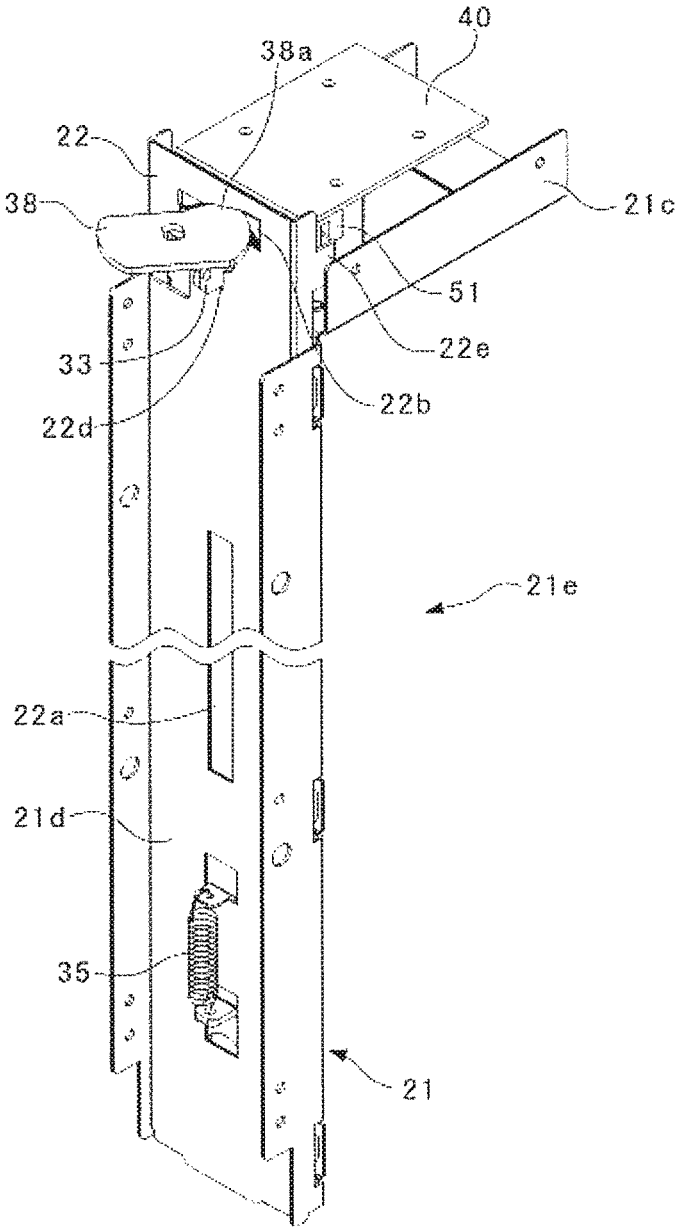
FIG. 26 is a perspective view showing the shutter opening operation of the card cassette device of FIG. 6, in which the state at the start of movement of the shutter is shown.

Next, when a person operates the lock key 39 from the outside to turn the lock plate 38 around its central axis by approximately 45° while keeping the aforementioned retracted state of the solenoid rod 31, the lock plate 38 and the engaging hole 22*b* have the relationship shown in FIGS. 24 to 26. Specifically, not only the operating part 38*b* of the lock plate 38 but also the cam part 38*a* thereof adjacent to the operating part 38*b* are gradually inserted into the engaging hole 22*b*. At this time, initially, the upper face of the operating part 38*b* starts to be contacted with the inclined edge portion 22*bz* located at the center of the hole 22*b* and as a result, an upward force starts to be applied to the shutter 22. Since the upper face of the operating part 38*b* has a similar inclination to the inclined edge portion 22*bz*, the upper face of the operating part 38*b* and the inclined edge portion 22*bz* are slid smoothly. Thereafter, the upper face of the cam part 38*a* starts to be contacted with the inclined edge portion 22*bz*; however, the upper face of the cam part 38*a* is flat and therefore, a larger upward force starts to be applied to the shutter 22 due to the mutual sliding action of the upper face of the cam part 38*a* and the inclined edge portion 22*bz*. As a result, the shutter 22 is raised gradually.

In addition, if the upper face of the cam part 38*a* starts to be contacted with the inclined edge portion 22*bz*, the contact between the operating part 38*b* and the inner edge of the engaging hole 22*b* will disappear.

Figure 28:
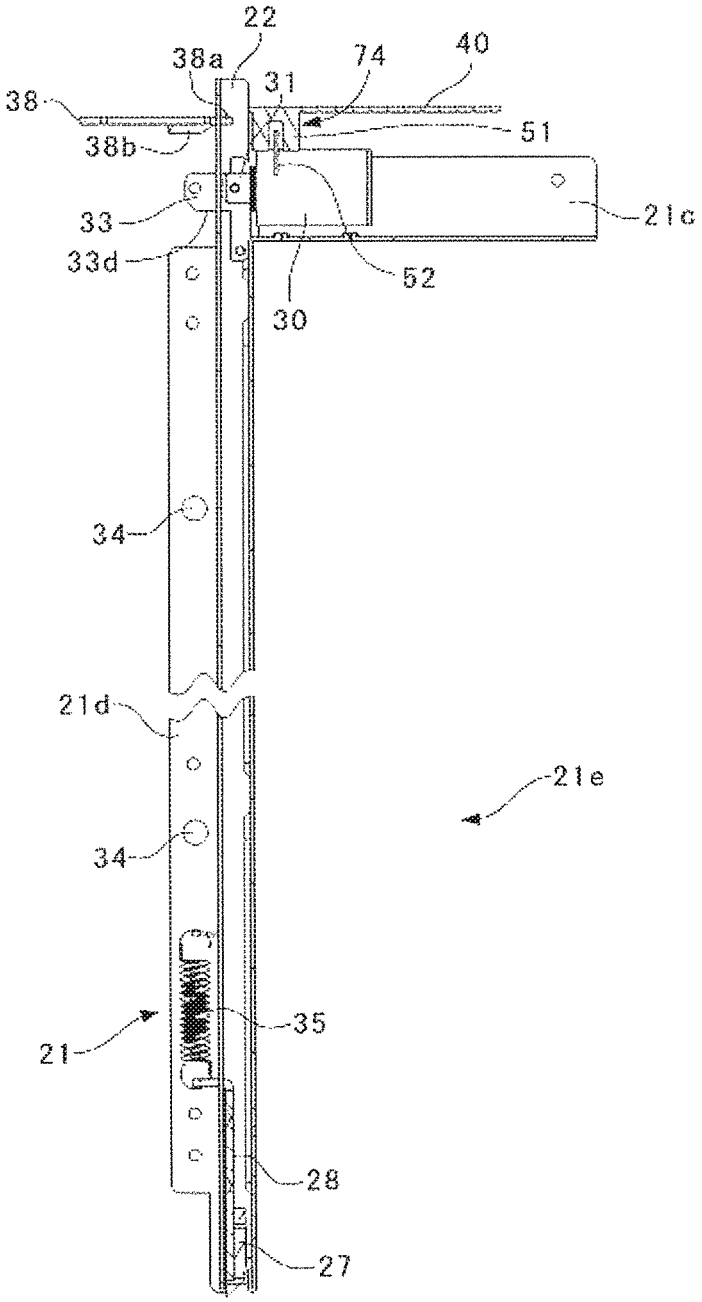
FIG. 28 is a cross-sectional view along the line XXVIII-XXVIII in FIG. 27.
Figure 29:
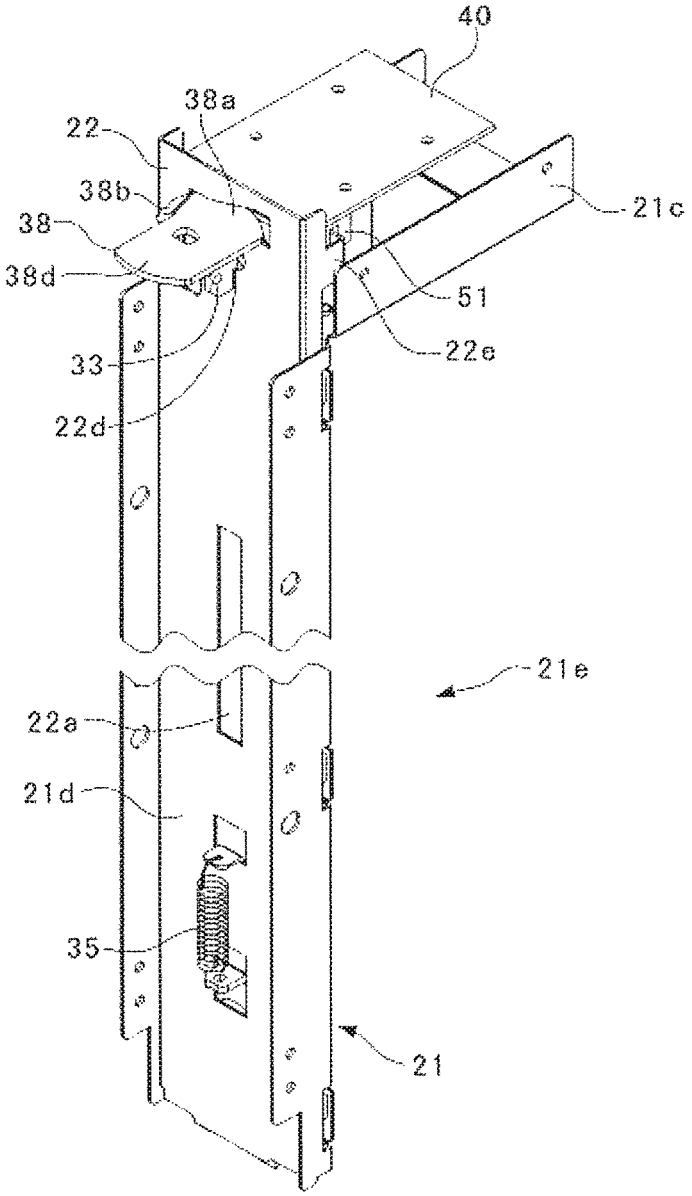
FIG. 29 is a perspective view showing the shutter opening operation of the card cassette device of FIG. 6, in which the state where the shutter is opened is shown.

Subsequently, when the person operates the lock key 39 to turn further the lock plate 38 around its central axis by approximately 45° while keeping the aforementioned retracted state of the rod 31, the lock plate 38 and the engaging hole 22*b* have a relationship shown in FIGS. 27 to 29. Specifically, the lock plate 38 is turned around its central axis by approximately 90° from its initial state, and almost all the operating part 38*b* of the lock plate 38 is disengaged from the engaging hole 22*b* and at the same time, only the cam part 38*a* is kept inserted into the hole 22*b*. At this time, the upper face of the cam part 38*a* is slid along the inclined edge portion 22*bz* while keeping the upper face of the cam part 38*a* in contact with the inclined edge portion 22*bz*. Therefore, a still larger upward force is applied to the shutter 22 in accordance with the inclination degree of the inclined edge portion 22*bz*, thereby raising the shutter 22 furthermore. Since the operating part 38*b* is not contacted with the inner edge of the engaging hole 22*b* at this time, the operating part 38*b* will never apply any force to the shutter 22.

Figure 27:
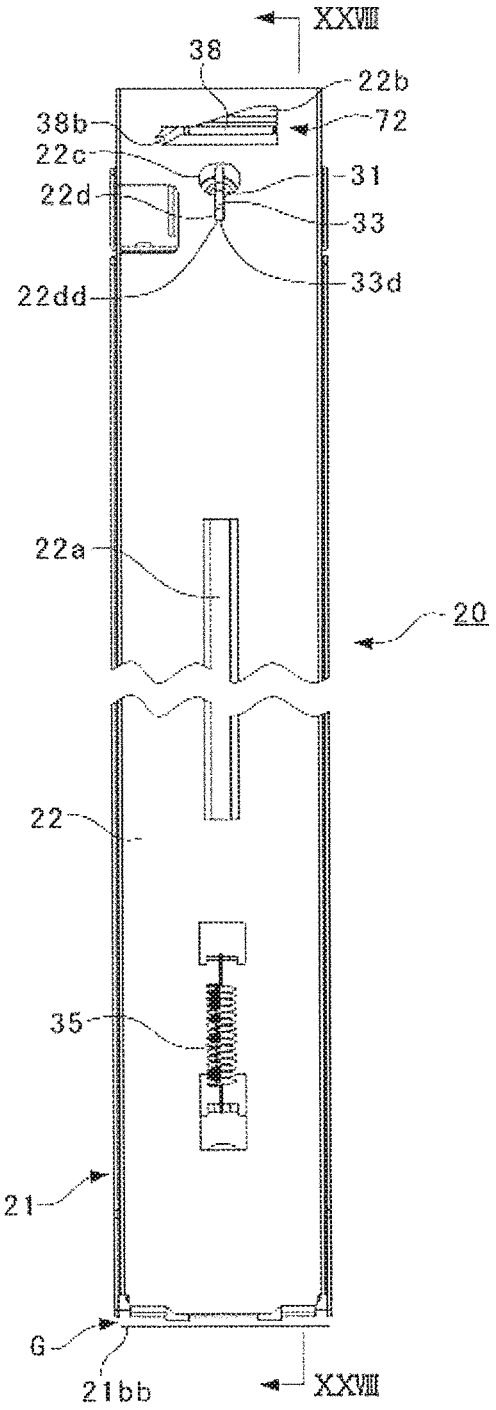
FIG. 27 is a partial front view showing the shutter opening operation of the card cassette device of FIG. 6, in which the state where the shutter is opened is shown.

When the lock plate 38 is turned in the aforementioned manner, a small gap G is formed between the lower end of the shutter 22 and the upper face 21*bb* of the bottom part 21 of the body 21, as shown in FIG. 27. This means that the card outlet 27*a* provided at the lower end of the body 21 is opened. In this way, the cards stored in the stacked form in the storing section 21*e* of the card cassette device 20 can be delivered to the outside one by one.

Here, the combination of the lock plate 38, the engaging hole 22*b*, and the lock key 39 constitutes an open state locking mechanism 72 for canceling the closed state of the shutter 22 and locking the shutter 22 in its open state.

Thereafter, if the card cassette device 20 needs to be detached from the main unit 10 of the card dispensing apparatus 1 again, it is sufficient that the lock plate 38 is turned in the reverse direction to thereby eliminate the engagement between the lock plate 38 and the engaging hole 22*b* of the shutter 22. If so, the shutter 22 will move downward automatically due to the resilient force of the spring 35 to return to the former closed position and as a result, the card outlet 27*a* is closed.

[Operation of Controllers in Card Dispensing Apparatus]

Next, the operation of the main unit controller 61 and the cassette device controller 65 including the mounting and dismounting of the card cassette device 20 will be explained below with reference to FIG. 32.

First, in the step S1, the main unit controller 61, which monitors the reference potential of the data line BDL on a regular basis, judges whether or not the reference potential of the data line BDL is in a relatively high level (i.e., the level H). If the judgement result is "No", the operation flow is returned to START and the controller 61 performs the step S1 again. If the judgement result is "Yes", the controller 61 understands or acknowledges the fact that the card cassette device 20 has been mounted on the main unit 10 of the card dispensing apparatus 1 by way of the change of the reference potential from the relatively low level (i.e., the level L) to the level H. Then, the operation flow advances to the next step S2.

In the step S2, the main unit controller 61 judges whether or not the card cassette device 20 thus mounted is conformable to the main unit 10. In other words, the controller 61 verifies the conformity of the device 20 with the unit 10. This verification operation is performed by comparing the ID (cassette identification information) of the card cassette device 20 obtained from the information storing device 68 with the ID (cassette identification information) of the main unit 10 obtained from the information storing device 63. If the judgement result is "No", in other words, the two IDs are not matched, the operation flow is jumped to the step S9, wherein a predetermined error handling process is performed. Thereafter, the operation flow advances to the next step S10, wherein the controller 61 judges whether or not the reference potential of the data line BDL is in the level L at every prescribed interval of time. This is to confirm the fact that the card cassette device 20 is not mounted on the main unit 10.

If the judgement result in the step S10 is "No", the controller 61 performs the judgement operation in the step 10 repeatedly. If the judgement result in the step S10 is "Yes", the controller 61 returns the flow to START and performs the step S1 and the subsequent steps again.

On the other hand, if the judgement result in the step S2 is "Yes", in other words, the two IDs are matched, the operation flow advances to the next step S3, wherein the main unit controller 61 sends an instruction to turn on (i.e., magnetize) the solenoid 30 to the cassette device controller 65 by way of the data lines BDL and CDL. In response to this instruction, the cassette device controller 65 sends a solenoid control signal SCS to the solenoid driving power supply 67, thereby magnetizing the solenoid 30. Due to magnetization of the solenoid 30, the rod 31 of the solenoid 30 is retracted to its body and the end 31*a* of the rod 31 is disengaged from the engaging hole 22*b* of the shutter 22. In this state, the shutter 22 can be raised and the card outlet 27*a* can be opened. Thereafter, the flow advances to the next step S4.

In the step S4, the cassette device controller 65 judges whether or not the shutter sensor (i.e., the photoelectric sensor 51 here) is turned on at every prescribed interval of time. If the judgement in the step S4 is "Yes", the photoelectric sensor 51 is turned on, in other words, the output signal PES of the sensor 51 is turned to the level L from the level H. This means that the shutter 22 is raised and the card outlet 27*a* is opened. (The shutter 22 is manually raised by a person.) Thereafter, the cassette device controller 65 sends a command to the main unit controller 61, notifying the controller 61 that the shutter 22 has been opened and that a card dispensing operation can be carried out. Thereafter, the operation flow advances to the next step S5.

In the step S5, a card dispensing operation is carried out as necessary.

In the next step S6, the cassette device controller 65 judges whether or not the shutter sensor (i.e., the photoelectric sensor 51) is turned off at every prescribed interval of time. If the judgement in the step S6 is "Yes", the photoelectric sensor 51 is turned off, in other words, the output signal PES of the sensor 51 is turned to the level H from the level L. This means that the shutter 22 is descent and the card outlet 27*a* is closed. Thereafter, the cassette device controller 65 sends a command to the main unit controller 61, notifying the controller 61 that the shutter 22 has been already closed and that a card dispensing operation cannot be already carried out. Thereafter, the operation flow advances to the next step S8.

In the step S8, the main unit controller 61 judges whether or not the reference potential of the data line BDL is in the level L at every prescribed interval of time. This is to confirm the fact that the card cassette device 20 is not mounted on the main unit 10, which is the same as the step S10.

If the judgement result in the step S8 is "No", the controller 61 performs the judgement operation in the step 8 repeatedly. If the judgement result in the step S8 is "Yes", the controller 61 returns the flow to START and performs the step S1 and the subsequent steps again.

In this way, the operation of the card dispensing apparatus 1 is controlled by the main unit controller 61 and the cassette device controller 65, thereby making it possible to dispense the cards only when the ID (i.e., identification information) of the card cassette device 20 stored in advance in the information storing device 68 is matched with the ID of the main unit 10 stored in advance in the information storing device 63.

Following this, the time-dependent operation of the card dispensing apparatus 1 in practical use including the mounting and dismounting of the card cassette device 20 will be explained below with reference to the timing charts of FIGS. 33A, 33B, and 33C.

Figure 33A:
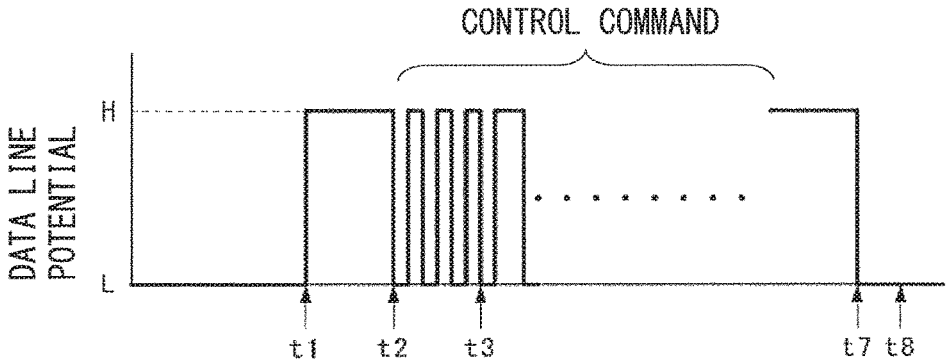
FIGS. 33A to 33C are timing charts showing the control operation of the card dispensing apparatus of FIG. 1.
Figure 33B:
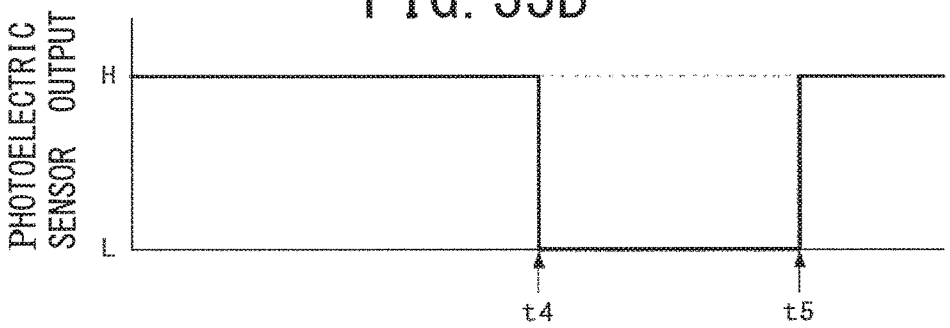
Figure 33C:
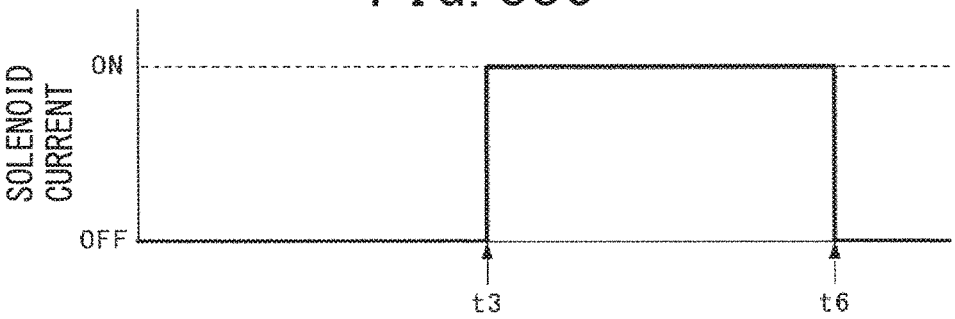

FIG. 33A shows the change of the reference potential of the data lines BDL and CDL, FIG. 33B shows the change of the output signal PES of the photoelectric sensor, and FIG. 33C shows the change of the current of the solenoid 30.

When the card cassette device 20 is mounted on the main unit 10 and then, the device 20 is detached from the unit 10, the main unit controller 61 and the cassette device controller 65 work together as follows.

First, when the card cassette device 20 is mounted on the main unit 10, the power supply line BPL, the data line BDL, and the ground line BGL of the main unit 10 are electrically connected to the power supply line CPL, the data line CDL, and the ground line CGL of the card cassette device 20 by way of the connectors 16 and 37, respectively. As a result, the transistor TR of the pull up circuit 66 is turned on, thereby changing the reference potential of the data lines BDL and CDL to the level H from the level L due to the operation of the pull up circuit 66 at the time t1 in FIG. 33A.

Figure 32:
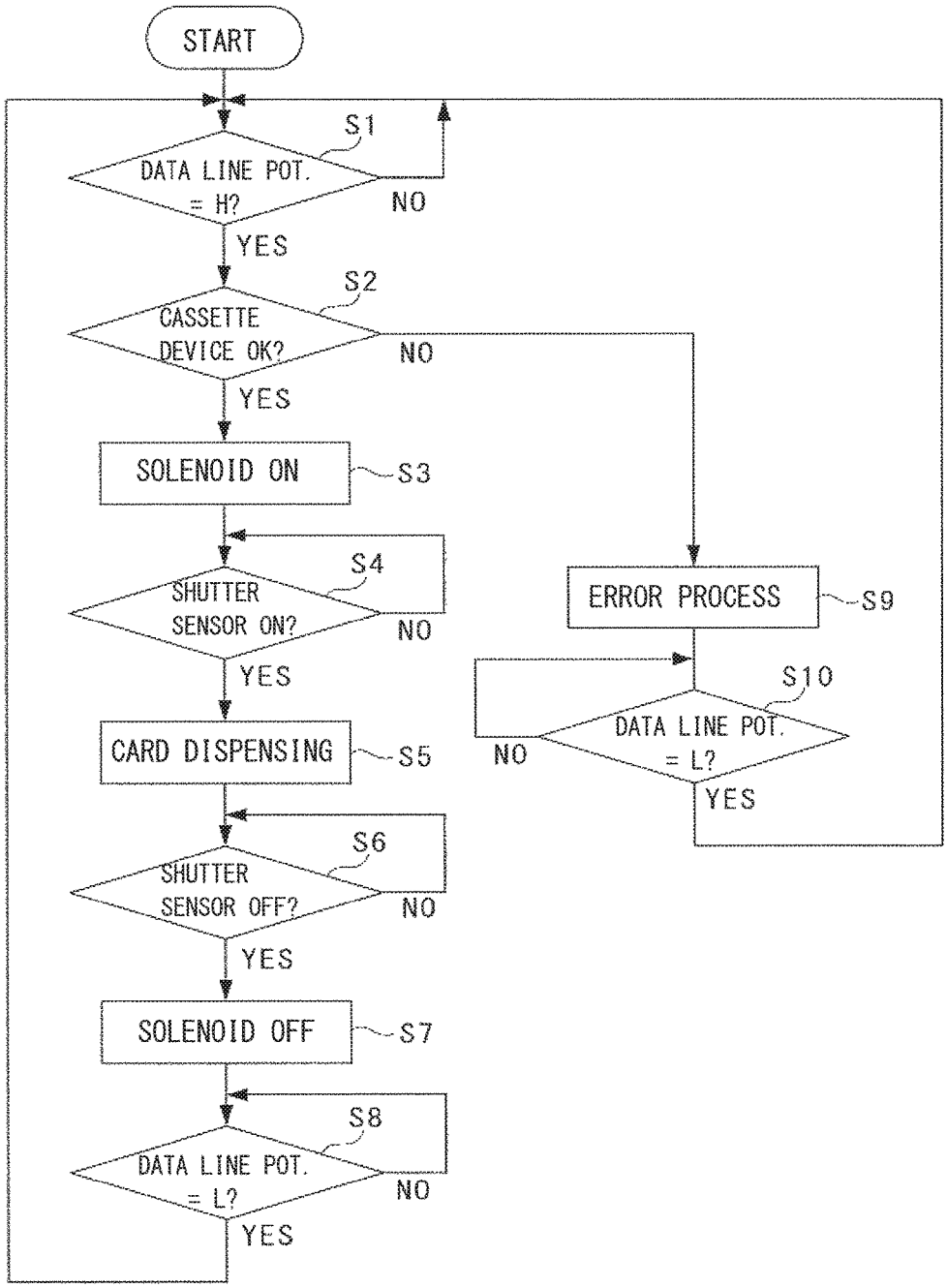
FIG. 32 is a flow chart showing the control operation of the card dispensing apparatus of FIG. 1.

Since the main unit controller 61 monitors the reference potential of the data line BDL on a regular basis, the controller 61 detects this reference potential change of the data line BDL to the level H and finds the mounting of the card cassette device 20 at the time t2 immediately after the time t1 in FIG. 33A (step S1 in FIG. 32).

Next, the main unit controller 61 judges whether or not the card cassette device 20 thus mounted is conformable to the main unit 10. Concretely speaking, the controller 61 sends a control command to the cassette device controller 65 of the card cassette device 20, thereby instructing the controller 65 to send its own ID to the controller 61. In response to this instruction, the cassette device controller 65 reads out its ID previously stored in the information storing device 68 and sends it to the main unit controller 61. Then, the controller 61 compared the ID information thus sent from the cassette device controller 65 with the ID of the main unit 10 that has been recorded in the data storing device 63, verifying the conformity of the card cassette device 20 with the main unit 10 (step S2 in FIG. 32).

If the card cassette device 20 thus mounted is judged conformable to the main unit 10, the main unit controller 61 sends an instruction to activate or magnetize the solenoid 30 to the cassette device controller 65. In response to this instruction, the controller 65 magnetizes the solenoid 30 at the time t3 in FIGS. 33A and 33C. Due to the magnetization of the solenoid 30, the solenoid rod 31 is retracted and disengaged from the engaging hole 22*b* of the shutter 22, which makes the shutter 22 movable vertically.

If the card cassette device 20 thus mounted is not conformable to the main unit 10, the main unit controller 61 performs the predetermined error handling process (step S9 in FIG. 32), which means that the card dispensing operation is prevented.

After the solenoid 30 is magnetized at the time t3, it is supposed that the lock key 39 is operated or turned by a person at the time t4 in FIG. 33B. In this case, the shutter 22 has been made vertically movable at the time t3 and therefore, the shutter 22 is moved upward due to the operation of the lock key 39 by way of the lock plate 38. This movement of the shutter 22 is immediately detected by the photoelectric sensor 51, and the output signal PES of the sensor 51 is changed from the level H to the level L. The cassette device controller 65 detects this change of the output signal PES and then, sends a control command to the main unit controller 61 to notify the controller 61 that the shutter 22 is in the open state.

After the time t4, the cassette device controller 65 monitors the change of the output signal PES of the photoelectric sensor 51 in order to find the future closing of the shutter 22.

It is supposed that the lock key 39 is operated or turned by a person in the opposite direction at the time t5 in FIG. 33B. In this case, the shutter 22 is automatically moved downward due to the resilient force of the spring 35, reaching its closed position. This movement of the shutter 22 is immediately detected by the photoelectric sensor 51, and the output signal PES of the sensor 51 is changed from the level L to the level H. The cassette device controller 65 detects this change of the output signal PES and then, sends a control command to the main unit controller 61 to notify the controller 61 that the shutter 22 is in the closed state.

After the time t5, the shutter 22 (and the card outlet 27*a*) is kept in the closed state where the card dispensing operation is impossible.

In response to the control command, the main unit controller 61 knows that the shutter 22 (and the card outlet 27*a*) is in the closed state and then, sends an instruction to deactivate or demagnetize the solenoid 30 to the cassette device controller 65. In response to this instruction, the controller 65 demagnetizes the solenoid 30 at the time t6 in FIG. 33C. Due to the demagnetization of the solenoid 30, the solenoid rod 31 is engaged with the engaging hole 22*b* of the shutter 22 again, which holds the shutter 22 so as not to move vertically. At the same time, the engaging piece 38*d* of the lock plate 38 is disengaged from the engaging hole 17 of the main unit 10. As a result, the card cassette device 20 is made detachable from the main unit 10.

Thereafter, when the card cassette device 20 is detached from the main unit 10 by a person, the transistor TR of the pull up circuit 66 is turned off, thereby changing the reference potential of the data lines BDL and CDL to the level L from the level H at the time t7 in FIG. 33A. The main unit controller 61 detects this reference potential change of the data line BDL and finds the dismounting of the card cassette device 20 at the time t8 immediately after the time t7 in FIG. 33A (step S8 in FIG. 32).

Because of the aforementioned structure and operation, the card cassette device 20 and the card dispensing apparatus 1 according to the embodiment of the invention have the following advantageous effects.

With the card cassette device 20, as explained above in detail, the shutter 22 for opening and closing the card outlet 27*a* that is movable along the front part 21*d* of the body 21 is provided and furthermore, the rod 31 (the stopper member) engageable with the rod inserting hole 22*c* (the stopper member engaging hole) of the shutter 22, and the lock plate 38 (the lock member) engageable with the engaging hole 22 (the lock member engaging hole) of the shutter 22 are provided.

Moreover, the combination of the rod 31, the rod inserting hole 22*c*, and the solenoid 30 (the stopper member moving device) constitutes the shutter fixing mechanism 71 for fixing the shutter 22 in its closed state, in which engagement or disengagement of the rod 31 with/from the rod inserting hole 22*c* can be performed by the solenoid 30. The combination of the lock plate 38, the engaging hole 22*b*, and the lock key 39 (the lock member moving device) constitute the open state locking mechanism 72 for canceling the closed state of the shutter 22 and locking the shutter 22 in its open state, in which engagement or disengagement of the lock plate 38 with/from the engaging hole 22*b* can be performed by the lock key 39.

Furthermore, the closed state of the shutter 22 generated by the shutter fixing mechanism 71 is unable to be eliminated without mounting the card cassette device 20 on the main unit 10 of the card dispensing apparatus 1, and the open state of the shutter 22 is able to be generated and locked by operating the lock key 39 after releasing the shutter movement preventing operation by the shutter fixing mechanism 71 in the mounted state where the device 20 is mounted on the unit 10.

Therefore, the movement of the shutter 22 for opening and closing the card outlet 27*a* can be directly prevented by the shutter fixing mechanism 71 and as a result, measures for illegally opening the card outlet 27*a* from the outside in the non-mounted state can be eliminated surely.

In addition, since the open state of the shutter 22 is able to be generated and locked by operating the lock key 39 of the open state locking mechanism 72 after mounting the card cassette device 20 on the main unit 10 and releasing the shutter movement preventing operation by the shutter fixing mechanism 71, the card outlet 27*a* can be opened according to the necessity in the mounted state.

In this way, with the card cassette device 20 according to the embodiment of the present invention, measures for illegally opening the card outlet 27*a* from the outside can be surely eliminated in the non-mounted state and the card outlet 27*a* can be opened according to the necessity in the mounted state and therefore, a higher security level than the prior art can be realized with a simple structure.

With the card dispensing apparatus 1 according to the embodiment of the present invention, as explained above, the apparatus 1 is configured to include the main unit 10 having the function of feeding cards in the predetermined direction, and the card cassette device 20 for storing the cards therein which is detachably mounted on the main unit 10. In the card cassette device 20, the shutter 22 which is movable along the front part 21*d* of the body 21 to open and close the card outlet 27*a* is provided, and the shutter fixing mechanism 71 for fixing the shutter 22 in the closed state thereof is provided. Activation and deactivation of the shutter fixing mechanism 71 is controlled by the cassette device controller 65 (the second controller) provided in the device 20.

When the card cassette device 20 is mounted on the main unit 10, the main unit controller 61 (the first controller) and the cassette device controller 65 are electrically interconnected by way of the data lines BDL and CDL to enable communication therebetween. In this state, the main unit controller 61 performs communication with the cassette device controller 65, verifying the conformity of the card cassette device 20 which has been mounted on the main unit 10 using the ID of the device 20 stored in the identification information storing device 63.

If the conformity of the card cassette device 20 is verified, the main unit controller 61 sends the instruction to deactivate the shutter fixing mechanism 71 to the card cassette controller 65. In response to this instruction, the shutter fixing mechanism 71 is deactivated and therefore, by operating the open state locking mechanism 72, the closed state of the shutter 22 can be canceled, in other words, the shutter 22 can be opened. This means that the card dispensing operation is possible as desired.

On the other hand, if the conformity of the card cassette device 20 is not verified, the main unit controller 61 does not send the instruction to deactivate the shutter fixing mechanism 71 to the card cassette controller 65 and therefore, the closed state of the shutter 22 is kept unchanged, in other words, the shutter 22 cannot be opened even if the open state locking mechanism 72 is operated. This means that the card dispensing operation is impossible.

Accordingly, measures for illegally opening the card outlet 27*a* from the outside can be surely eliminated in the non-mounted state where the card cassette device 20 is not mounted on the main unit 10. This means that that a higher security level than that of the prior art can be realized with a simple structure.

In addition, in the case where the conformity of the card cassette device 20 is not verified, the shutter fixing mechanism 71 keeps the closed state of the shutter 22 and therefore, non-conformable card cassette devices can be prevented from being used. This means that only the use of a predetermined card cassette device 20 which is conformable to the main unit 10 can be allowed, in other words, the card cassette device 20 and the main unit 10 can be made to have the relationship of one-to-one correspondence.

OTHER EMBODIMENTS

It is needless to say that the present invention is not limited to the above-described embodiment and its variations. Any other modification is applicable to the embodiment and variations.

For example, in the above-described embodiment of the present invention, as the shutter fixing mechanism 71, the solenoid 30 having the rod 31, the rod inserting hole 22*c* of the shutter 22, and the spring 32 fitted on the rod 31 are used; however, the present invention is not limited to this. The shutter fixing mechanism 71 may be formed using an electric motor or other driving devices.

Although the pull up circuit 66 is used in the card cassette device 20 in the above-described embodiment, the present invention is not limited to this. A pull down circuit may be used for this purpose.

Moreover, as the open state locking mechanism 72, the lock plate 38, the engaging hole 22*b* of the shutter 22, and the lock key 39 for turning the lock plate 38 are used in the above-described embodiment; however, the present invention is not limited to this. The open state locking mechanism 72 may be formed using any other parts and/or devices.

The structural elements used in the card cassette device 20 and the main unit 10 and their shapes and sizes are preferred examples of the present invention; it is needless to say that any other structural elements may be used and these shapes and sized may be changed according to the necessity.

The card dispensing apparatus and the card cassette device according to the present invention are applicable to any apparatus or device (e.g., a card processing apparatus) having the function of storing a plurality of cards and feeding and/or dispensing the cards one by one according to the necessity.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A card cassette device configured to be mountable on a main unit of a target apparatus, comprising:

a body having a storing section for storing cards and a card outlet for sending out the cards, wherein the storing section is formed in the body and the card outlet is formed in a front part of the body;

a shutter for opening and closing the card outlet, wherein the shutter is movable along the front part of the body and has a stopper engaging hole and a lock engaging hole;

a stopper provided on the body, wherein the stopper is engageable with the stopper engaging hole of the shutter;

a stopper actuator for moving the stopper and/or the stopper engaging hole to perform engagement or disengagement of the stopper with/from the stopper engaging hole;

a lock provided on the body, wherein the lock is engageable with the lock engaging hole of the shutter; and a lock actuator for moving the lock and/or the lock engaging hole to perform engagement or disengagement of the lock member with/from the lock member engaging hole;

wherein the stopper, the stopper engaging hole, and the stopper actuator together defines a shutter fixing assembly for fixing the shutter in a closed state;

the lock, the lock engaging hole, and the lock actuator together defining an open state locking assembly for canceling the closed state of the shutter and locking the shutter in an open state;

the shutter fixing assembly is configured in such a way that the closed state of the shutter generated by the shutter fixing assembly is unable to be eliminated without mounting the card cassette device on a main unit of a target apparatus; and the open state locking assembly is configured in such a way that the open state of the shutter is able to be generated and locked by operating the lock actuator after releasing a shutter movement preventing operation by the shutter fixing assembly in a mounted state where the card cassette device is mounted on the main unit.

2. The card cassette device according to claim 1, wherein the stopper actuator includes a solenoid and the stopper is integrated with a rod of the solenoid.

3. The card cassette device according to claim 1, wherein a guide is fixed to the stopper and a guide engaging hole is formed in the shutter; and the guide is guided by the guide engaging hole according to the movement of the shutter in the state where the stopper is disengaged from the stopper engaging hole.

4. The card cassette device according to claim 2, wherein when the solenoid is in a demagnetized state, the shutter is fixed in the closed state, and when the solenoid is turned to a magnetized state, the fixed, closed state of the shutter is released and an open state of the shutter can be generated by operating the lock actuator.

5. The card cassette device according to claim 1, wherein the lock comprises a cam part having a predetermined cam function which is generated by engagement of the lock with the lock engaging hole of the shutter.

6. The card cassette device according to claim 1, wherein the lock comprises a cam part having a predetermined cam function which is generated by engagement of the lock with the lock engaging hole of the shutter, and the shutter is moved due to the cam function of the cam part, thereby opening the card outlet.

7. The card cassette device according to claim 1, wherein the lock comprises a cam part having a predetermined cam function which is generated by engagement of the lock with the lock engaging hole of the shutter, and the cam part is slid with an inner edge of the lock engaging hole, thereby moving the shutter to open the card outlet.

8. The card cassette device according to claim 1, wherein a lock key is provided on the body as the lock actuator, and the lock key is operable from the outside of the body.

9. The card cassette device according to claim 1, wherein the shutter is biased in a direction of closing the card outlet by a biasing device, and the lock actuator moves the shutter against a biasing force of the biasing device.

* * * * *